US006052661A

United States Patent [19]

Yamaura et al.

[11] Patent Number: 6,052,661

[45] **Date of Patent: *Apr. 18, 2000**

[54] SPEECH ENCODING APPARATUS AND SPEECH ENCODING AND DECODING APPARATUS

[75] Inventors: Tadashi Yamaura; Hirohisa Tasaki; Shinya Takahashi, all of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/777,874

[22] Filed: Dec. 31, 1996

[30] Foreign Application Priority Data

May 29, 1996 [JP] Japan ..... 8-135240

[51] Int. Cl.[7] ..... G10L 19/00

[52] U.S. Cl. ..... 704/222; 704/220; 704/207; 704/224

[58] Field of Search ..... 704/214, 219, 704/211, 220, 221, 222, 223, 206, 207, 217, 224, 225, 230

[56] References Cited

U.S. PATENT DOCUMENTS

| | | | |
|---|---|---|---|
| 5,195,168 | 3/1993 | Yong | 704/220 |
| 5,235,670 | 8/1993 | Lin | 704/200 |
| 5,305,421 | 4/1994 | Li | 704/219 |
| 5,396,576 | 3/1995 | Miki et al. | 704/222 |
| 5,579,433 | 11/1996 | Jarvinen | 704/219 |

FOREIGN PATENT DOCUMENTS

| | | |
|---|---|---|
| 514912A2 | 11/1992 | European Pat. Off. . |
| 64-40899 | 2/1989 | Japan . |
| 4-344699 | 12/1992 | Japan . |
| 07334194 | 12/1995 | Japan . |

OTHER PUBLICATIONS

Kroon et al., "Pitch Predictors with High Temporal Resolution," pp. 661–664, International Conference on Acoustics, Speech, and Signal Processing, Apr. 3–6, 1990.

Chen et al., "8 KB/S Low–Delay Celp Coding of Speech," pp. 25–31, Speech and Audio Coding for Wireless and Network Applications, Jan. 1, 1993.

*Primary Examiner*—David R. Hudspeth
*Assistant Examiner*—Abul K. Azad

[57] ABSTRACT

A speech encoding apparatus capable of averting the deterioration of synthesis speech quality in encoding the input speech and of generating a high-quality synthesis output speech through small quantities of computation. The apparatus includes a target speech generation part for generating from the input speech a target speech vector of a vector length corresponding to a delay parameter; an adaptive codebook for generating from previously generated excitation signals an adaptive vector of the vector length corresponding to the delay parameter; an adaptive code search part for evaluating the distortion of a synthesis vector obtained from the adaptive vector with respect to the target speech vector so as to search for the adaptive vector conducive to the least distortion; and a frame code generation part for generating an excitation signal of a frame length from the adaptive vector conducive to the least distortion.

47 Claims, 13 Drawing Sheets

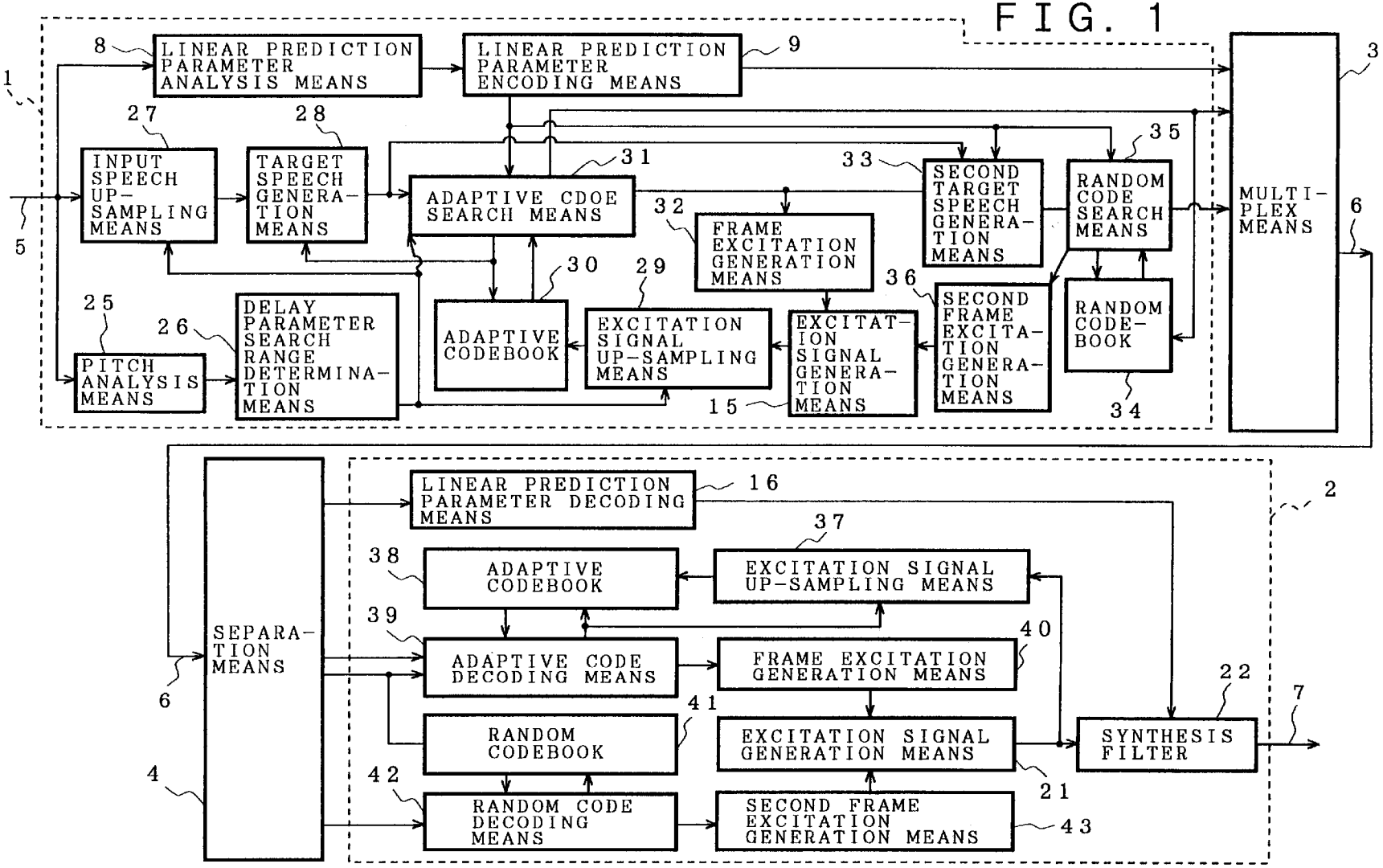
FIG. 1
MULTI-PLEX MEANS
RANDOM CODE SEARCH MEANS
RANDOM CODE-BOOK
SECOND TARGET SPEECH GENERA-TION MEANS
SECOND FRAME EXCITA-TION GENERA-TION MEANS
EXCITAT-ION SIGNAL GENERA-TION MEANS
FRAME EXCITATION GENERATION MEANS
EXCITATION SIGNAL UP-SAMPLING MEANS
ADAPTIVE CDOE SEARCH MEANS
ADAPTIVE CODEBOOK
LINEAR PREDICTION PARAMETER ENCODING MEANS
LINEAR PREDICTION PARAMETER ANALYSIS MEANS
TARGET SPEECH GENERA-TION MEANS
DELAY PARAMETER SEARCH RANGE DETERMINA-TION MEANS
INPUT SPEECH UP-SAMPLING MEANS
PITCH ANALYSIS MEANS
SYNTHESIS FILTER
EXCITATION SIGNAL UP-SAMPLING MEANS
FRAME EXCITATION GENERATION MEANS
EXCITATION SIGNAL GENERATION MEANS
SECOND FRAME EXCITATION GENERATION MEANS
LINEAR PREDICTION PARAMETER DECODING MEANS
ADAPTIVE CODEBOOK
ADAPTIVE CODE DECODING MEANS
RANDOM CODEBOOK
RANDOM CODE DECODING MEANS
SEPARA-TION MEANS POWER AT (1) : LOW W1 : LOW
POWER AT (2) : MEDIUM W2 : MEDIUM
POWER AT (3) : HIGH W3 : HIGH CORRELATION BETWEEN (1) AND (2) : LOW W1 : HIGH
CORRELATION BETWEEN (2) AND (3) : MEDIUM W2 : LOW
CORRELATION BETWEEN (1) AND (3) : HIGH W3 : HIGH POSITION(1) :TRAILING EDGE OF FRAME W1:HIGH
POSITION(2) :MIDDLE OF FRAME W2:MEDIUM
POSITION(3) :LEADING EDGE OF FRAME W3:LOW

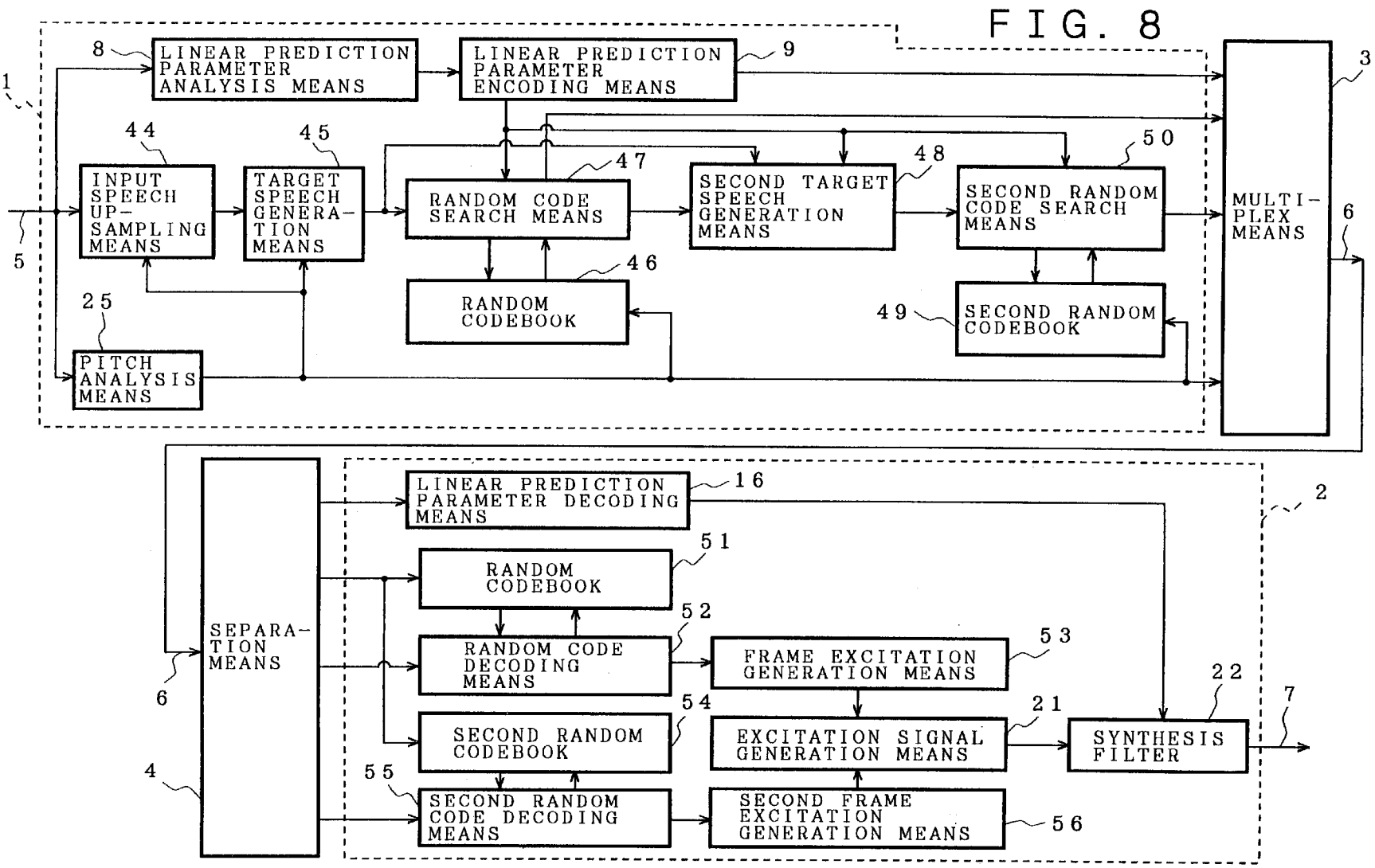
FIG. 8
MULTI-PLEX MEANS
SECOND RANDOM CODE SEARCH MEANS
SECOND RANDOM CODEBOOK
SECOND TARGET SPEECH GENERATION MEANS
LINEAR PREDICTION PARAMETER ENCODING MEANS
RANDOM CODE SEARCH MEANS
RANDOM CODEBOOK
LINEAR PREDICTION PARAMETER ANALYSIS MEANS
TARGET SPEECH GENERA-TION MEANS
INPUT SPEECH UP-SAMPLING MEANS
PITCH ANALYSIS MEANS
SYNTHESIS FILTER
FRAME EXCITATION GENERATION MEANS
EXCITATION SIGNAL GENERATION MEANS
SECOND FRAME EXCITATION GENERATION MEANS
LINEAR PREDICTION PARAMETER DECODING MEANS
RANDOM CODEBOOK
RANDOM CODE DECODING MEANS
SECOND RANDOM CODEBOOK
SECOND RANDOM CODE DECODING MEANS
SEPARA-TION MEANS

SPEECH ENCODING APPARATUS AND SPEECH ENCODING AND DECODING APPARATUS

BACKGROUND OF THE INVENTION

1. Field of the Invention

This invention relates to a speech encoding apparatus and a speech encoding and decoding apparatus for compressing and encoding speech signals or audio signals into digital signals.

2. Description of the Related Art

FIG. 9 is a block diagram of a typical overall constitution of a conventional speech encoding and decoding apparatus which divides an input speech into spectrum envelope information and excitation signal information and encodes the excitation signal information by the frame. The apparatus of FIG. 9 is identical to what is disclosed in JP-A 64/40899.

In FIG. 9, reference numeral 1 stands for an encoder, 2 for a decoder, 3 for multiplex means, 4 for separation means, 5 for an input speech, 6 for a transmission line, and 7 for an output speech. The encoder 1 comprises linear prediction parameter analysis means 8, linear prediction parameter encoding means 9, an adaptive codebook 10, adaptive code search means 11, error signal generation means 12, a random codebook 13, random code search means 14 and excitation signal generation means 15. The decoder 2 is made up of linear prediction parameter decoding means 16, an adaptive codebook 17, adaptive code decoding means 18, a random codebook 19, random code decoding means 20, excitation signal generation means 21 and a synthesis filter 22.

Described below is how the conventional speech encoding and decoding apparatus divides an input speech into spectrum envelope information and excitation signal information and encodes the excitation signal information by the frame.

The encoder 1 first receives a digital speech signal sampled illustratively at 8 kHz as the input speech 5. The linear prediction parameter analysis means 8 analyzes the input speech 5 and extracts a linear prediction parameter which is the spectrum envelope information of the speech. The linear prediction parameter encoding means 9 then quantizes the extracted linear prediction parameter and outputs a code representing that parameter to the multiplex means 3. At the same time, the linear prediction parameter encoding means 9 outputs the quantized linear prediction parameter to the adaptive code search means 11, error signal generation means 12 and random code search means 14.

The excitation signal information is encoded as follows. The adaptive codebook 10 holds previously generated excitation signals that are input from the excitation signal generation means 15. Upon receipt of a delay parameter l from the adaptive code search means 11, the adaptive codebook 10 returns to the search means 11 an adaptive vector corresponding to the received delay parameter l, the vector length of the adaptive vector being equal to the frame length. The adaptive vector is made by extracting a signal of frame length, which is l-sample previous to the current frame. If the parameter l is shorter than the frame length, the adaptive vector is made by extracting a signal of vector length corresponding to the delay parameter l, which is l-sample previous to the current frame, and by outputting that signal repeatedly until the frame length is reached. FIG. 10(*a*) is a view of a typical adaptive vector in effect when the delay parameter l is equal to or longer than the frame length, and FIG. 10(*b*) is a view of a typical adaptive vector in effect when the delay parameter l is shorter than the frame length.

Suppose that the delay parameter l falls within a range of $20 \leqq l \leqq 128$. On that assumption, the adaptive code search means 11 receives the adaptive vector from the adaptive codebook 10, accepts the quantized linear prediction parameter from the linear prediction parameter encoding means 9, and generates a synthesis vector by linear prediction with the received vector and parameter. The adaptive code search means 11 then obtains the perceptual weighted distortion of the synthesis vector with respect to the input speech vector extracted by the frame from the input speech 5. Evaluating the distortion through comparison, the adaptive code search means 11 acquires the delay parameter L and the adaptive gain β conducive to the least distortion. The delay parameter L and a code representing the adaptive gain β are output to the multiplex means 3. At the same time, the adaptive code search means 11 generates an adaptive excitation signal by multiplying the adaptive vector corresponding to the delay parameter L by the adaptive gain β, and outputs the generated adaptive excitation signal to the error signal generation means 12 and excitation signal generation means 15.

The error signal generation means 12 generates a synthesis vector by linear prediction with the adaptive excitation signal from the adaptive code search means 11 and the quantized linear prediction parameter from the linear prediction parameter encoding means 9. The error signal generation means 12 then obtains an error signal vector as the difference between the input speech vector extracted from the input speech by the frame on the one hand, and the synthesis vector generated as described on the other, and outputs the error signal vector to the random code search means 14.

The random codebook 13 holds illustratively as many as N random vectors generated from random noise. Given a random code i from the random code search means 14, the random codebook 13 outputs a random vector corresponding to the received code. The random code search means 14 receives any one of the N random vectors from the random codebook 13, admits the quantized linear prediction parameter from the linear prediction parameter encoding means 9, and generates a synthesis vector by linear prediction with the received vector and parameter. The random code search means 14 then obtains the perceptual weighted distortion of the synthesis vector with respect to the error signal vector from the error signal generation means 12. Evaluating the distortion through comparison, the random code search means 14 acquires the random code I and the random gain γ conducive to the least distortion. The random code I and a code representing the random gain γ are output to the multiplex means 3. At the same time, the random code search means 14 generates a random excitation signal by multiplying the random vector corresponding to the random code I by the random gain γ, and outputs the generated random excitation signal to the excitation signal generation means 15.

The excitation signal generation means 15 receives the adaptive excitation signal from the adaptive code search means 11, admits the random excitation signal from the random code search means 14, and adds the two signals to generate an excitation signal. The excitation signal thus generated is output to the adaptive codebook 10.

When the encoding process above is completed, the multiplex means 3 places onto the transmission line 6 the code representing the quantized linear prediction parameter, the delay parameter L, the random code I, and the codes denoting the excitation gains β and γ.

The decoder 2 operates as follows. The separation means 4 first receives the output of the multiplex means 3. In turn, the separation means 4 outputs through a separating process the code of the linear prediction parameter to the linear prediction parameter decoding means 16, the delay parameter L and the code of the adaptive gain β to the adaptive code decoding means 18, and the random code I and the code of the random gain γ to the random code decoding means 20.

The linear prediction parameter decoding means 16 decodes the received code back to the linear prediction parameter and sends the parameter to the synthesis filter 22. The adaptive code decoding means 18 reads from the adaptive codebook 17 an adaptive vector corresponding to the delay parameter L, decodes the received code back to the adaptive gain β, and generates an adaptive excitation signal by multiplying the adaptive vector by the adaptive gain β. The adaptive excitation signal thus generated is output to the excitation signal generation means 21. The random code decoding means 20 reads from the random codebook 19 a random vector corresponding to the random code I, decodes the received code back to the random gain γ, and generates a random excitation signal by multiplying the random vector by the random gain γ. The random excitation signal thus generated is output to the excitation signal generation means 21.

The excitation signal generation means 21 receives the adaptive excitation signal from the adaptive code decoding means 18, admits the random excitation signal from the random code decoding means 20, and adds the two received signals to generate an excitation signal. The excitation signal thus generated is output to the adaptive codebook 17 and synthesis filter 22. The synthesis filter 22 generates an output speech 7 by linear prediction with the excitation signal from the excitation signal generation means 21 and the linear prediction parameter from the linear prediction parameter decoding means 16.

An improved version of the above-described conventional speech encoding and decoding apparatus, capable of providing the output speech of higher quality, is described by P. Kroon and B. S. Atal in "Pitch Predictors with High Temporal Resolution" (ICASSP '90, pp. 661–664, 1990).

The improved conventional speech encoding and decoding apparatus has a constitution which is a variation of what is shown in FIG. 9. In the improved constitution, the adaptive code search means 11 deals with the delay parameter not only of an integer but also of a fractional rational number. The adaptive codebooks 10 and 17 each generate an adaptive vector corresponding to the delay parameter of a fractional rational number by interpolation between the samples of the excitation signal generated in the previous frames, and output the adaptive vector thus generated. FIGS. 11(*a*) and 11(*b*) show examples of adaptive vectors generated when the delay parameter l is a fractional rational number. FIG. 11(*a*) is a view of a typical adaptive vector in effect when the delay parameter l is equal to or longer than the frame length, and FIG. 11(*b*) is a view of a typical adaptive vector in effect when the delay parameter l is shorter than the frame length.

Constituted as outlined, the above improved apparatus determines the delay parameter at a precision level higher than the sampling frequency of the input speech, and generates the adaptive vector accordingly. As such, the improved apparatus can generate output speech of higher quality than the apparatus of JP-A 64/40899.

Another conventional speech encoding and decoding apparatus is disclosed in JP-A 4/344699. FIG. 12 is a block diagram of a typical overall constitution of that disclosed conventional speech encoding and decoding apparatus.

In FIG. 12, those parts with their counterparts already shown in FIG. 9 are given the same reference numerals, and detailed descriptions of the parts are omitted where they are repetitive. In FIG. 12, reference numerals 23 and 24 denote random codebooks which are different from those in FIG. 9.

The encoding and decoding apparatus of the above constitution operates as follows. Suppose that the delay parameter l falls within the range of $20 \leqq l \leqq 128$ as before. On that assumption, the adaptive code search means 11 in the encoder 1 receives the adaptive vector from the adaptive codebook 10, accepts the quantized linear prediction parameter from the linear prediction parameter encoding means 9, and generates a synthesis vector by linear prediction with the adaptive vector and the quantized linear prediction parameter. The adaptive code search means 11 then obtains the perceptual weighted distortion of the synthesis vector with respect to the input speech vector extracted by the frame from the input speech 5. Evaluating the distortion through comparison, the adaptive code search means 11 acquires the delay parameter L and the adaptive gain β conducive to the least distortion. The delay parameter L and a code representing the adaptive gain β are output to the multiplex means 3 and random codebook 23. At the same time, the adaptive code search means 11 generates an adaptive excitation signal by multiplying the adaptive vector corresponding to the delay parameter L by the adaptive gain β, and outputs the generated adaptive excitation signal to the error signal generation means 12 and excitation signal generation means 15.

The random codebook 23 holds illustratively as many as N random vectors generated from random noise. Given a random code i from the random code search means 14, the random codebook 23 generates a random vector corresponding to the received code, puts the generated vector corresponding to the delay parameter L into a periodical format, and outputs the periodical random vector thus prepared. FIG. 13(*a*) is a view of a typical random vector in the periodical format. If the delay parameter L is a fractional rational number, the random codebook 23 generates a random vector by interpolation between the samples of the random vector, and puts the vector thus generated into a periodical format, as shown in FIG. 13(*b*).

The random code search means 14 receives any one of the N random vectors in the periodical format from the random codebook 23, admits the quantized linear prediction parameter from the linear prediction parameter encoding means 9, and generates a synthesis vector by linear prediction with the received vector and parameter. The random code search means 14 then obtains the perceptual weighted distortion of the synthesis vector with respect to the error signal vector from the error signal generation means 12. Evaluating the distortion through comparison, the random code search means 14 acquires the random code I and the random gain γ conducive to the least distortion. The random code I and a code representing the random gain γ are output to the multiplex means 3. At the same time, the random code search means 14 generates a random excitation signal by multiplying the periodical random vector corresponding to the random code I by the random gain γ, and outputs the generated random excitation signal to the excitation signal generation means 15.

When the encoding process above is completed, the multiplex means 3 places onto the transmission line 6 the code representing the quantized linear prediction parameter, the delay parameter L, the random code I, and the codes denoting the excitation gains β and γ.

The decoder 2 operates as follows. The separation means 4 first receives the output of the multiplex means 3. In turn, the separation means 4 outputs through a separating process the code of the linear prediction parameter to the linear prediction parameter decoding means 16, the delay parameter L and the code of the adaptive gain β to the adaptive code decoding means 18 and random codebook 24, and the random code I and the code of the random gain γ to the random code decoding means 20.

Like the random codebook 23 on the encoding side, the random codebook 24 holds as many as N random vectors. Given the random code I from the random code decoding means 20, the random codebook 23 generates a random vector corresponding to the received code I, puts the generated vector corresponding to the delay parameter L into a periodical format, and outputs the periodical random vector thus prepared to the random code decoding means 20.

The random code decoding means 20 decodes the code of the random gain γ back to the random gain γ, and multiplies by the gain γ the periodical random vector received from the random codebook 24 so as to generate a random excitation signal. The random excitation signal thus generated is output to the excitation signal generation means 21.

The excitation signal generation means 21 receives the adaptive excitation signal from the adaptive code decoding means 18, accepts the random excitation signal from the random code decoding means 20, and adds the two inputs to generate an excitation signal. The excitation signal thus prepared is output to the adaptive codebook 17 and synthesis filter 22. The synthesis filter 22 receives the excitation signal from the excitation signal generation means 21, accepts the linear prediction parameter from the linear prediction parameter decoding means 16, and outputs an output speech 7 by linear prediction with the two inputs.

In a code searching during the encoding process, the conventional speech encoding and decoding apparatus outlined above puts the adaptive vector or random vector corresponding to the delay parameter into a periodical format, so as to generate a vector of the frame length. A synthesis vector is generated by linear prediction with the vector thus prepared. The apparatus then obtains the distortion of the synthesis vector with respect to the input speech vector of the frame length. One disadvantage of this apparatus is that huge amounts of computations are needed for the code searching because of large quantities of operations involved with the linear predictive synthesis process.

SUMMARY OF THE INVENTION

It is therefore an object of the present invention to overcome the above and other deficiencies and disadvantages of the prior art and to provide a speech encoding apparatus and a speech encoding and decoding apparatus capable of averting the deterioration of synthesis speech quality in encoding the input speech and of generating a high-quality synthesis output speech with small quantities of computation.

In carrying out the invention and according to a first aspect thereof, there is provided a speech encoding apparatus for dividing an input speech into spectrum envelope information and excitation signal information and for encoding the excitation signal information by the frame. This speech encoding apparatus comprises: target speech generation means for generating from the input speech a target speech vector of a vector length corresponding to a delay parameter; an adaptive codebook for generating from previously generated excitation signals an adaptive'vector of the vector length corresponding to the delay parameter; adaptive code search means for evaluating the distortion of a synthesis vector obtained from the adaptive vector with respect to the target speech vector so as to search for the adaptive vector conducive to the least distortion; and frame excitation generation means for generating an excitation signal of a frame length from the adaptive vector conducive to the least distortion.

In a first preferred structure according to the invention, the speech encoding apparatus further comprises: second target speech generation means for generating a second target speech vector from the target speech vector and the adaptive vector conducive to the least distortion; a random codebook for generating a random vector of the vector length corresponding to the delay parameter; random code search means for evaluating the distortion of a second synthesis vector obtained from the random vector with respect to the second target speech vector so as to search for the random vector conducive to the least distortion; and second frame excitation generation means for generating a second excitation signal of the frame length from the random vector conducive to the least distortion.

According to a second aspect of the invention, there is provided a speech encoding apparatus for dividing an input speech into spectrum envelope information and excitation signal information and for encoding the excitation signal information by the frame. This speech encoding apparatus comprises: target speech generation means for generating from the input speech a target speech vector of a vector length corresponding to a delay parameter; a random codebook for generating a random vector of the vector length corresponding to the delay parameter; random code search means for evaluating the distortion of a synthesis vector obtained from the random vector with respect to the target speech vector so as to search for the random vector conducive to the least distortion; and frame excitation generation means for generating an excitation signal of a frame length from the random vector conducive to the least distortion.

In a second preferred structure of the speech encoding apparatus according to the invention, the vector length of the target speech vector and that of the random vector are determined in accordance with the pitch period of the input speech.

In a third preferred structure of the speech encoding apparatus according to the invention, the vector length corresponding to the delay parameter is a rational number.

In a fourth preferred structure of the speech encoding apparatus according to the invention, the target speech generation means divides an input speech in a frame into portions each having the vector length corresponding to the delay parameter, and computes a weighted mean of the input speech portions each having the vector length so as to generate the target speech vector.

In a fifth preferred structure of the speech encoding apparatus according to the invention, the target speech generation means divides an input speech having the length of an integer multiple of the vector length corresponding to the delay parameter, into portions each having the vector length, and computes a weighted mean of the input speech portions so as to generate the target speech vector.

In a sixth preferred structure of the speech encoding apparatus according to the invention, the length of the integer multiple of the vector length corresponding to the delay parameter is equal to or greater than the frame length.

In a seventh preferred structure of the speech encoding apparatus according to the invention, the target speech generation means computes a weighted mean of the input speech by the vector length in accordance with the characteristic quantity of the input speech portions each having the vector length corresponding to the delay parameter, thereby determining the weight for generating the target speech vector.

In an eighth preferred structure of the speech encoding apparatus according to the invention, the characteristic quantity of the input speech portions each having the vector length corresponding to the delay parameter includes at least power information about the input speech.

In a ninth preferred structure of the speech encoding apparatus according to the invention, the characteristic quantity of the input speech portions each having the vector length corresponding to the delay parameter includes at least correlative information about the input speech.

In a tenth preferred structure of the speech encoding apparatus according to the invention, the target speech generation means computes a weighted mean of the input speech by the vector length in accordance with the temporal relationship of the input speech portions each having the vector length corresponding to the delay parameter, thereby determining the weight for generating the target speech vector.

In an eleventh preferred structure of the speech encoding apparatus according to the invention, the target speech generation means fine-adjusts the temporal relationship of the input speech by the vector length when computing a weighted mean of the input speech portions each having the vector length corresponding to the delay parameter.

In a twelfth preferred structure of the speech encoding apparatus according to the invention, the frame excitation generation means repeats at intervals of the vector length the excitation vector of the vector length corresponding to the delay parameter in order to acquire a periodical excitation vector, thereby generating the excitation signal of the frame length.

In a thirteenth preferred structure of the speech encoding apparatus according to the invention, the frame excitation generation means interpolates between frames the excitation vector of the vector length corresponding to the delay parameter, thereby generating the excitation signal.

In a fourteenth preferred structure of the speech encoding apparatus according to the invention, the adaptive code search means includes a synthesis filter and uses an impulse response from the synthesis filter to compute repeatedly the distortion of the synthesis vector obtained from the adaptive vector with respect to the target speech vector.

In a fifteenth preferred structure according to the invention, the speech encoding apparatus further comprises input speech up-sampling means for up-sampling the input speech, and the target speech generation means generates the target speech vector from the up-sampled input-speech.

In a sixteenth preferred structure according to the invention, the speech encoding apparatus further comprises excitation signal up-sampling means for up-sampling previously generated excitation signals, and the adaptive codebook generates the adaptive vector from the up-sampled previously generated excitation signals.

In a seventeenth preferred structure of the speech encoding apparatus according to the invention, the input speech up-sampling means changes the up-sampling rate of the up-sampling operation in accordance with the delay parameter.

In an eighteenth preferred structure of the speech encoding apparatus according to the invention, the input speech up-sampling means changes the up-sampling rate of the up-sampling operation on the input speech and the excitation signal only within a range based on the vector length corresponding to said delay parameter.

According to the present invention, there is provided a speech encoding and decoding apparatus for dividing an input speech into spectrum envelope information and excitation signal information, encoding the excitation signal information by the frame, and decoding the encoded excitation signal information so as to generate an output speech. The encoding side of this speech encoding and decoding apparatus comprises: target speech generation means for generating from the input speech a target speech vector of a vector length corresponding to a delay parameter; an adaptive codebook for generating from previously generated excitation signals an adaptive vector of the vector length corresponding to the delay parameter; adaptive code search means for evaluating the distortion of a synthesis vector obtained from the adaptive vector with respect to the target speech vector so as to search for the adaptive vector conducive to the least distortion; and frame excitation generation means for generating an excitation signal of a frame length from the adaptive vector conducive to the least distortion. The decoding side of this apparatus comprises: an adaptive codebook for generating the adaptive vector of the vector length corresponding to the delay parameter; and frame excitation generation means for generating the excitation signal of the frame length from the adaptive vector.

In one preferred structure of the speech encoding and decoding apparatus according to the invention, the encoding side further comprises: second target speech generation means for generating a second target speech vector from the target speech vector and the adaptive vector; a random codebook for generating a random vector of the vector length corresponding to the delay parameter; random code search means for evaluating the distortion of a second synthesis vector obtained from the random vector with respect to the second target speech vector so as to search for the random vector conducive to the least distortion; and second frame excitation generation means for generating a second excitation signal of the frame length from the random vector conducive to the least distortion. The decoding side of this apparatus further comprises: a random codebook for generating the random vector of the vector length corresponding to the delay parameter; and second frame excitation generation means for generating the excitation signal of the second frame length from the random vector.

According to the present invention, there is provided a speech encoding and decoding apparatus for dividing an input speech into spectrum envelope information and excitation signal information, encoding the excitation signal information by the frame, and decoding the encoded excitation signal information so as to generate an output speech. The encoding side of this speech encoding and decoding apparatus comprises: target speech generation means for generating from the input speech a target speech vector of a vector length corresponding to a delay parameter; a random codebook for generating a random vector of the vector length corresponding to the delay parameter; random code search means for evaluating the distortion of a synthesis vector obtained from the random vector with respect to the target speech vector so as to search for the random vector conducive to the least distortion; and frame excitation generation means for generating an excitation signal of a frame length from the random vector conducive to the least distortion. The decoding side of this apparatus comprises: a random codebook for generating the random vector of the vector length corresponding to the delay parameter; and frame excitation generation means for generating the excitation signal of the frame length from the random vector.

BRIEF DESCRIPTION OF THE DRAWINGS

FIG. 1 is a block diagram outlining the overall constitution of a speech encoding apparatus and a speech decoding apparatus practiced as a first embodiment of the invention;

FIG. 8 is a block diagram showing the overall constitution of a speech encoding apparatus and a speech decoding apparatus practiced as a tenth embodiment of the invention;

DETAILED DESCRIPTION OF THE PREFERRED EMBODIMENTS

First Embodiment

Figure 2:
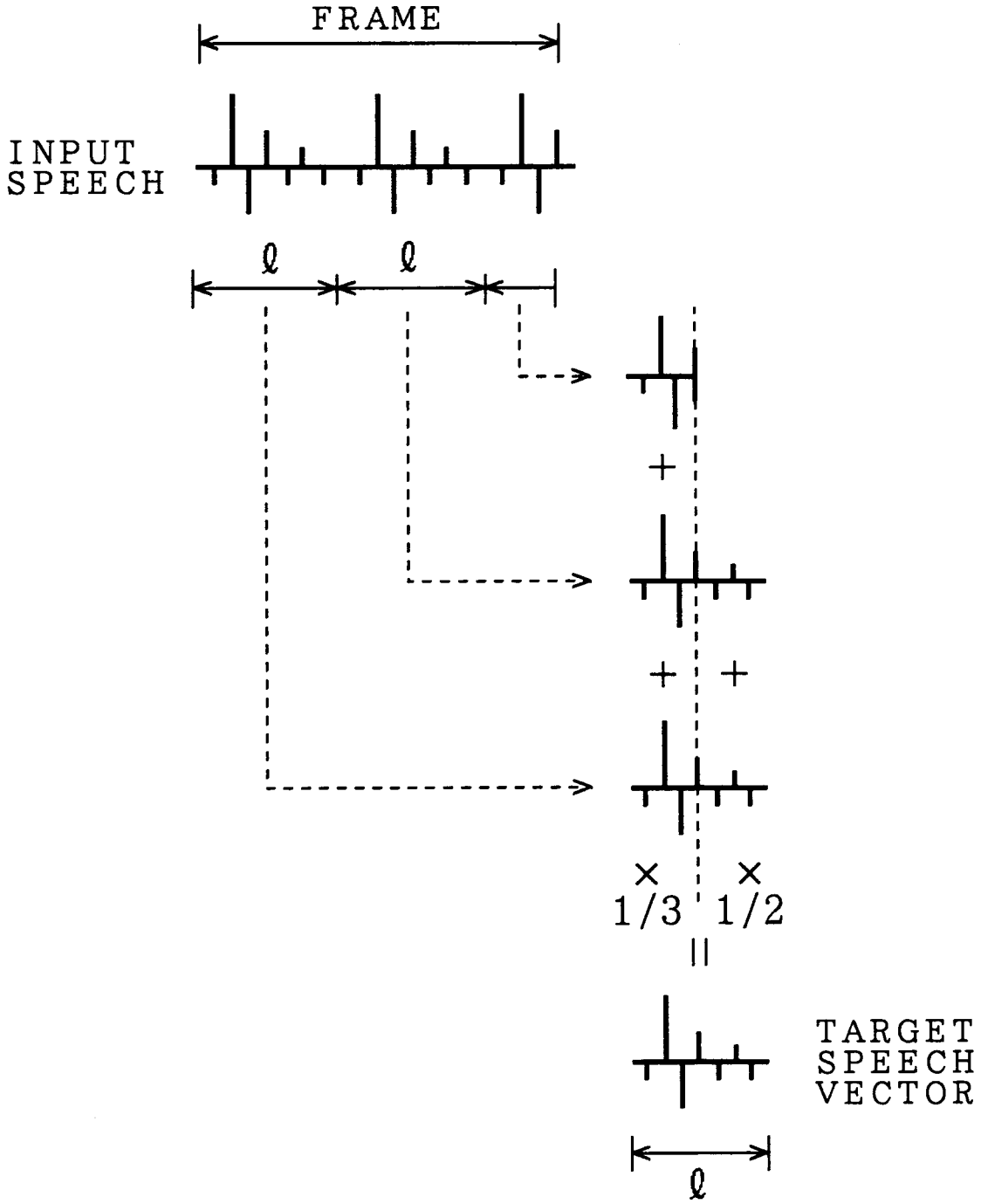
FIG. 2 is an explanatory view depicting how target speech generation means of the first embodiment typically operates.

FIG. 1 is a block diagram outlining the overall constitution of a speech encoding apparatus and a speech decoding apparatus practiced as the first embodiment of the invention. In FIG. 1, reference numeral 1 stands for an encoder, 2 for a decoder, 3 for multiplex means, 4 for separation means, 5 for an input speech, 6 for a transmission line and 7 for an output speech.

The encoder 1 comprises the following components: linear prediction parameter analysis means 8; linear prediction parameter encoding means 9; excitation signal generation means 15; pitch analysis means 25 that extracts the pitch period of the input speech; delay parameter search range determination means 26 that determines the range to search for a delay parameter when an adaptive vector is searched for; input speech up-sampling means 27 that up-samples the input speech; target speech generation means 28 that generates a target speech vector of a vector length corresponding to the delay parameter in effect; excitation signal up-sampling means 29 that up-samples previously generated excitation signals; an adaptive codebook 30 that generates from previously generated excitation signals an adaptive vector of the vector length corresponding to the delay parameter; adaptive code search means 31 that evaluates the distortion of a synthesis vector obtained from the adaptive vector with respect to the target speech vector, in order to search for the adaptive vector conducive to the least distortion; frame excitation generation means 32 that generates an adaptive excitation signal of a frame length from the adaptive vector of the vector length corresponding to the delay parameter; second target speech generation means 33 that generates a second target speech vector of the vector length corresponding to the delay parameter in a search for a random vector; a random codebook 34 that outputs the random vector of the vector length corresponding to the delay parameter; random code search means 35 that evaluates the distortion of a synthesis vector obtained from the random vector with respect to the second target speech vector, in order to search for the random vector conducive to the least distortion; and second frame excitation generation means 36 that generates the random excitation signal of the frame length from the random excitation signal of the vector length corresponding to the delay parameter.

The decoder 2 comprises the following components: linear prediction parameter decoding means 16; excitation signal generation means 21; a synthesis filter 22; excitation signal up-sampling means 37 that up-samples previously generated excitation signals; an adaptive codebook 38 that outputs the adaptive vector of the vector length corresponding to the delay parameter; adaptive code decoding means 39 that decodes the adaptive excitation signal of the vector length corresponding to the delay parameter; frame excitation generation means 40 that generates the adaptive excitation signal of the frame length from the adaptive excitation signal of the vector length corresponding to the delay parameter; a random codebook 41 that outputs the random vector of the vector length corresponding to the delay parameter; random code decoding means 42 that decodes the random excitation signal of the vector length corresponding to the delay parameter; and second frame excitation generation means 43 that generates the random excitation signal of the frame length from the random excitation signal of the vector length corresponding to the delay parameter.

The encoder 1 of the first embodiment operates as follows. First, a digital speech signal, or a digital audio signal, sampled illustratively at 8 kHz is received as the input speech 5. Analyzing the input speech 5, the linear prediction parameter analysis means 8 extracts a linear prediction parameter which is spectrum envelope information of the speech. The linear prediction parameter encoding means 9 quantizes the extracted linear prediction parameter, and outputs the code representing the parameter to the multiplex means 3. At the same time, the quantized linear prediction parameter is output to the adaptive code search means 31, second target speech generation means 33 and random code search means 35.

The pitch analysis means 25 extracts a pitch period P by analyzing the input speech 5. Given the pitch period P, the delay parameter search range determination means 26 determines the search range for a delay parameter l $$l\ \min \leq l \leq l\ \max$$

in which to search for an adaptive vector illustratively through the use of the equations (1) below. The search range thus determined for the delay parameter is output to the input speech up-sampling means 27, excitation signal up-sampling means 29 and adaptive code search means 31. The equations used above are:

$$l\ min = P - \Delta P$$

$$l\ max = P + \Delta P \quad (1)$$

where, $\Delta P$ is illustratively P/10.

Upon receipt of the delay parameter search range from the delay parameter search range determination means 26, the input speech up-sampling means 27 up-samples the input speech 5 at a sampling rate corresponding to the received search range in the frame illustratively. The up-sampled input speech is output to the target speech generation means 28. The up-sampling rate is determined illustratively as follows: if l min<45, the up-sampling is performed at a rate four times as high; if 45≦l min<65, the up-sampling is conducted at a rate twice as high; if 65≦l min, the up-sampling is not carried out.

On receiving the up-sampled input speech of a frame length from the input speech up-sampling means 27, the target speech generation means 28 divides the up-sampled input speech into input speech portions each having the period 1 in accordance with the delay parameter l from the adaptive code search means 31, and computes a weighted mean of the divided input speech portions each having the vector length corresponding to the delay parameter l. In this manner, the target speech generation means 28 generates a target speech vector of the vector length corresponding to the delay parameter l. The target speech vector thus generated is output to the adaptive code search means 31 and second target speech generation means 33. The delay parameter l may be an integer as well as a fractional rational number. The delay parameter l may be any one of the following values where l int means integer value. If l<45, the delay is any one of "l int," "l int+¼," "l int+½," and "l int+¾"; if 45≦l<65, the delay is "l int" or "l int+½"; if 65≦l, the delay is "l int."

FIG. 2 shows a typical target speech vector having the vector length corresponding to the delay parameter l generated from the input speech having the frame length. If the delay parameter l is equal to or greater than the frame length, no weighted mean is computed, and the input speech of the frame length is regarded as the target speech vector.

When receiving previously generated excitation signals from the excitation signal generation means 15, the excitation signal up-sampling means 29 up-samples only the excitation signal interval which is necessary in the search for an adaptive code corresponding to the delay parameter search range received from the delay parameter search range determination means 26. The up-sampling is performed at a sampling rate according to the delay parameter search range. The resulting excitation signal is output to the adaptive codebook 30. The up-sampling rate is determined illustratively as follows: if l<45, the up-sampling is performed at a rate four times as high; if 45≦l<65, the up-sampling is conducted at a rate twice as high; if 65≦l, the up-sampling is not carried out.

Given the up-sampled excitation signal from the excitation signal up-sampling means 29, the adaptive codebook 30 outputs to the adaptive code search means 31 an adaptive vector of the vector length, which corresponds to the delay parameter l received from the adaptive code search means 31. The adaptive vector is obtained by extracting a signal, which is l-sample previous to the current frame. If the delay parameter l is equal to or greater than the frame length, the adaptive vector is made by extracting a signal of the frame length, which is l-sample previous to the current frame.

The adaptive code search means 31 has a synthesis filter and obtains an impulse response of the synthesis filter using the quantized linear prediction parameter received from the linear prediction parameter encoding means 9. Given a delay parameter l that falls within the range of l min≦l≦l max, the adaptive code search means 31 generates a synthesis vector by repeatedly computing the adaptive vector from the adaptive codebook 30 through the use of the impulse response. The adaptive code search means 31 then obtains the perceptual weighted distortion of the synthesis vector with respect to the target speech vector from the target speech generation means 28. Evaluating the distortion through comparison, the adaptive code search means 31 acquires the delay parameter L and the adaptive gain β conducive to the least distortion. The delay parameter L and a code representing the adaptive gain β are output to the multiplex means 3 and random codebook 34. At the same time, the adaptive code search means 31 generates an adaptive excitation signal by multiplying the adaptive vector corresponding to the delay parameter L by the adaptive gain β, and outputs the generated adaptive excitation signal to the frame excitation generation means 32 and second target speech generation means 33. The adaptive excitation signal is a signal of L sample length if the parameter L is shorter than the frame length, and is a signal of the frame length if the parameter L is equal to or greater than the frame length.

Given the adaptive excitation signal from the adaptive code search means 31, the frame excitation generation means 32 repeats the received signal illustratively at intervals of L to generate a periodical adaptive excitation signal of the frame length. The generated adaptive excitation signal of the frame length is output to the excitation signal generation means 15.

The second target speech generation means 33 receives the adaptive excitation signal from the adaptive code search means 31, accepts the quantized linear prediction parameter from the linear prediction parameter encoding means 9, and generates a synthesis vector by linear prediction with the adaptive excitation signal and the quantized linear prediction parameter. The second target speech generation means 33 then acquires the difference between the target speech vector from the target speech generation means 28 on the one hand, and the synthesis vector on the other. The difference thus acquired is output as a second target speech vector to the random code search means 35.

The random codebook 34 holds as many as N random vectors generated illustratively from random noise. The random codebook 34 extracts and outputs, by the vector length corresponding to the delay parameter L, the random vector corresponding to a random code i received from the random code search means 35. If the delay parameter L is equal to or greater than the frame length, the random vector having that frame length is output.

The random code search means 35 receives any one of the N random vectors extracted from the random codebook 34, accepts the quantized linear prediction parameter from the linear prediction parameter encoding means 9, and generates a synthesis vector by linear prediction with the received random vector and the quantized linear prediction parameter. The random code search means 35 then obtains the perceptual weighted distortion of the synthesis vector with respect to the second target speech vector received from the second target speech generation means 33. Evaluating the distortion through comparison, the random code search means 35 finds the random code I and the random gain γ conducive to the least distortion. The random code I and a code representing the random gain γ are output to the multiplex means 3. At the same time, the random code search mean 35 generates a random excitation signal by multiplying the random vector corresponding to the random code I by the random gain γ. The random excitation signal thus generated is output to the second frame excitation generation means 36.

The second frame excitation generation means 36 receives the random excitation signal from the random code search means 35, and repeats the received signal illustratively at intervals of L to generate a periodical random excitation signal of the frame length. The generated random excitation signal of the frame length is output to the excitation signal generation means 15.

The excitation signal generation means 15 receives the adaptive excitation signal of the frame length from the frame excitation generation means 32, accepts the random excitation signal of the frame length from the second frame excitation generation means 36, and adds the two inputs to generate an excitation signal. The excitation signal thus generated is output to the excitation signal up-sampling means 29.

When the encoding process above is completed, the multiplex means 3 outputs onto the transmission line 6 the code representing the quantized linear prediction parameter, the delay parameter L, the random excitation signal I, and the codes representing the excitation gains β and γ.

The operations described above characterize the encoder 1 of the first embodiment. What follows is a description of how the decoder 2 of the same embodiment illustratively operates.

On receiving the output of the multiplex means 3, the separation means 4 outputs through a separating process the code of the linear prediction parameter to the linear prediction parameter decoding means 16, the delay parameter L to the adaptive code decoding means 39 and random codebook 41, the code of the excitation gain β to the adaptive code decoding means 39, and the random code I and the code of the excitation gain γ to the random code decoding means 42.

The adaptive code decoding means 39 first outputs the delay parameter L to the excitation signal up-sampling means 37 and adaptive codebook 38. Given previously generated excitation signals from the excitation signal generation means 21, the excitation signal up-sampling means 37 up-samples only the excitation signal interval which is necessary for generating the adaptive vector corresponding to the delay parameter L received from the adaptive code decoding means 39. The up-sampling is performed at a sampling rate according to the delay parameter L. The up-sampled excitation signal is output to the adaptive codebook 38. The up-sampling rate is determined in the same manner as with the excitation signal up-sampling means 29 of the encoder 1.

Upon receipt of the up-sampled excitation signal from the excitation signal up-sampling means 37, the adaptive codebook 38 generates from the received signal an adaptive vector of the vector length, which corresponds to the delay parameter L received from the adaptive code decoding means 39. The adaptive vector thus generated is output to the adaptive code decoding means 39. The adaptive vector is obtained by extracting a signal, which is L-sample previous to the current frame. If the delay parameter L is equal to or greater than the frame length, the adaptive vector is made by extracting a signal of the frame length, which is L-sample previous to the current frame.

The adaptive code decoding means 39 decodes the code of the adaptive gain β back to the gain β, generates an adaptive excitation signal by multiplying the adaptive vector from the adaptive codebook 38 by the adaptive gain β, and outputs the adaptive excitation signal thus generated to the frame excitation generation means 40. Given the adaptive excitation signal from the adaptive code decoding means 39, the frame excitation generation means 40 repeats the signal illustratively at intervals of L to generate a periodical adaptive excitation signal of the frame length. The generated adaptive excitation signal of the frame length is output to the excitation signal generation means 21.

Like the random codebook 34 on the encoder side, the random codebook 41 holds as many as N random vectors. From these vectors, the random vector corresponding to the random code I received from the random code decoding means 42 is extracted in the vector length corresponding to the delay parameter L. The random vector thus obtained is output to the random code decoding means 42.

The random code decoding means 42 decodes the code of the random gain γ back to the random gain γ, and generates a random excitation signal by multiplying the extracted random vector from the random codebook 41 by the random gain γ. The random excitation signal thus generated is output to the second frame excitation generation means 43. Given the random excitation signal from the random code decoding means 42, the second frame excitation generation means 43 repeats the received signal illustratively at intervals of L to generate a periodical random excitation signal of the frame length. The generated random excitation signal of the frame length is output to the excitation signal generation means 21.

The excitation signal generation means 21 receives the adaptive excitation signal of the frame length from the frame excitation generation means 40, accepts the random excitation signal of the frame length from the second frame excitation generation means 43, and adds the two inputs to generate an excitation signal. The excitation signal thus generated is output to the excitation signal up-sampling means 37 and synthesis filter 22. The synthesis filter 22 receives the excitation signal from the excitation signal generation means 21 and the linear prediction parameter from the linear prediction parameter decoding means 16, and generates an output speech 7 by linear prediction with the excitation signal and the linear prediction parameter.

The operations described so far characterize the decoder 2 of the first embodiment.

According to the first embodiment of the invention, upon determining an optimum delay parameter, a weighted mean is effected to the signal periodically extracted from the input speech to generate the target speech vector of the vector length l if the delay parameter l is shorter than the frame length. Then, the synthesis vector is generated by linear prediction with the adaptive vector of the vector length l, and the distortion of the synthesis vector is obtained and evaluated with respect to the target speech vector. Further, upon determining an optimum random code, the synthesis vector is generated by linear prediction with the random vector of the vector length l, the distortion of the synthesis vector is also obtained and evaluated with respect to the second target speech vector of the vector length l. These operations make it possible to avert the deterioration of synthesis speech quality and to generate a synthesis speech of high quality with small amounts of computations.

Second Embodiment

In the first embodiment, as described, the frame excitation generation means 32 and 40 as well as the second frame excitation generation means 36 and 43 repeat at intervals of L the adaptive excitation signal or random excitation signal of the vector length, which corresponds to the delay parameter L so as to generate in a periodical format the adaptive excitation signal or random excitation signal of the frame length. Alternatively, a second embodiment of the invention may waveform-interpolate the adaptive excitation signal or random excitation signal of the vector length, which corresponds to the delay parameter L between frames at intervals of L in order to generate the adaptive excitation signal or random excitation signal of the frame length.

The second embodiment smoothes out changes in the excitation signal between frames, whereby the reproducibility of the synthesis speech is improved and the quality thereof enhanced.

Third Embodiment

In the first and the second embodiments of the invention, as described, the frame excitation generation means and second frame excitation generation means first generate the adaptive excitation signal and random excitation signal both having the frame length on the basis of the adaptive excitation signal and random excitation signal with the vector length corresponding to the delay parameter L. The two signals are then added up to generate the excitation signal of the frame length. Alternatively, a third embodiment of the invention may add the adaptive excitation signal and random excitation signal each having the vector length corresponding to the delay parameter L in order to generate the excitation signal of the vector length corresponding to the delay parameter L. The excitation signal thus generated may be repeated illustratively at intervals of L to generate the excitation signal of the frame length.

Fourth Embodiment

Figure 12:
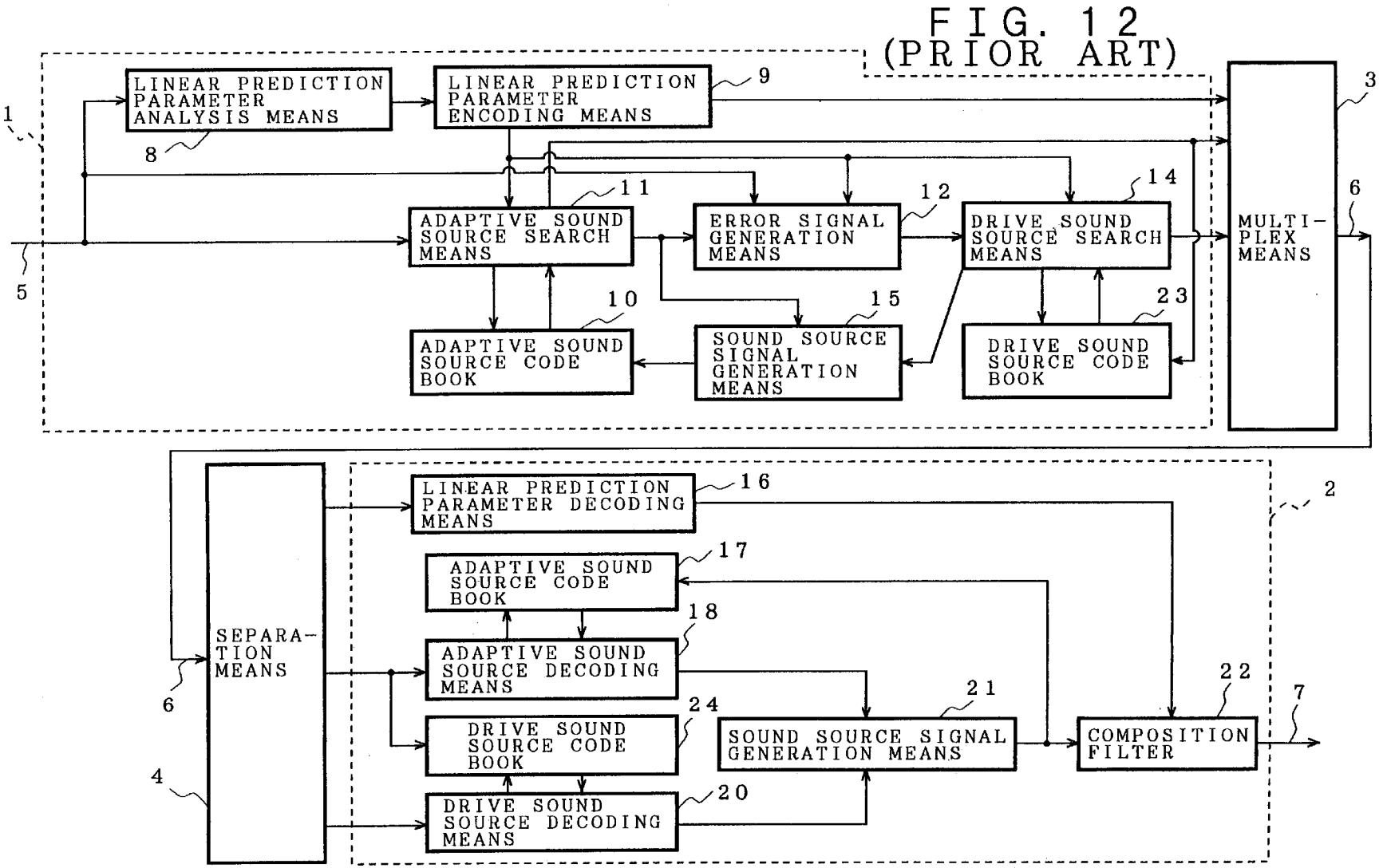
FIG. 12 (PRIOR ART)
FIG. 12 is a block diagram outlining the overall constitution of another conventional speech encoding and decoding apparatus.
Figure 13:
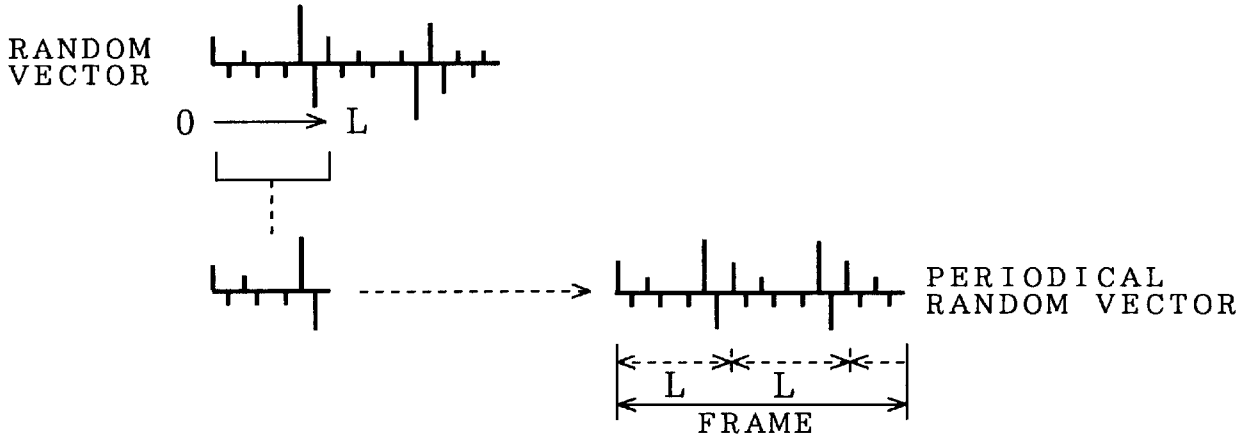
FIG. 13 (a) (PRIOR ART)
FIGS. 13(*a*) and 13(*b*) are explanatory views showing typical periodical random vectors used by the conventional speech encoding and decoding apparatus.
Figure 13:
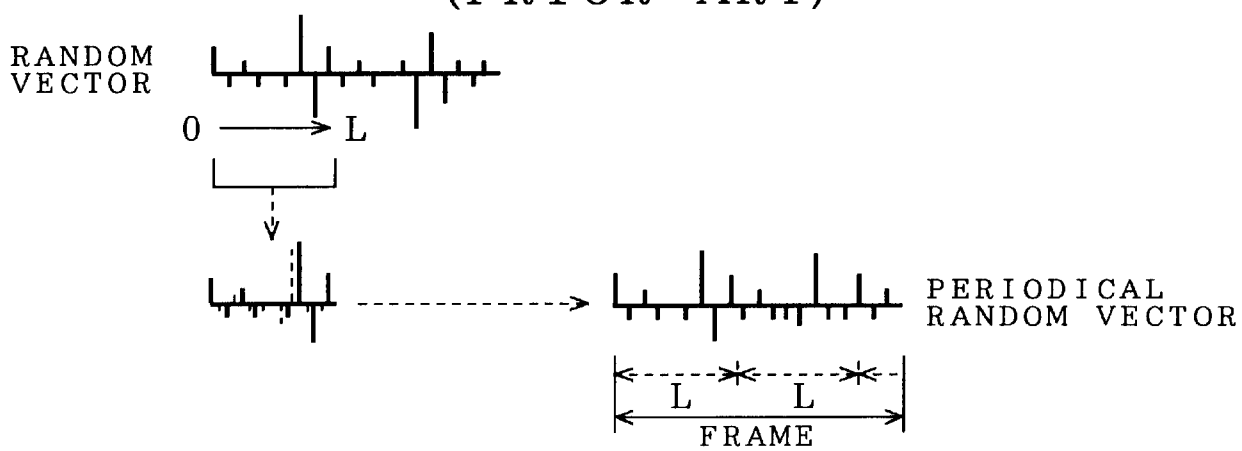
FIG. 13 (b) (PRIOR ART)

In the first embodiment, as described, both the encoder and the decoder have novel constitutions improving on their conventional counterparts. Alternatively, a fourth embodiment of the invention may comprise an encoder identical in constitution to its counterpart in the first embodiment while having a decoder constituted in the same manner as the conventional decoder shown in FIG. 12.

Fifth Embodiment

Figure 3:
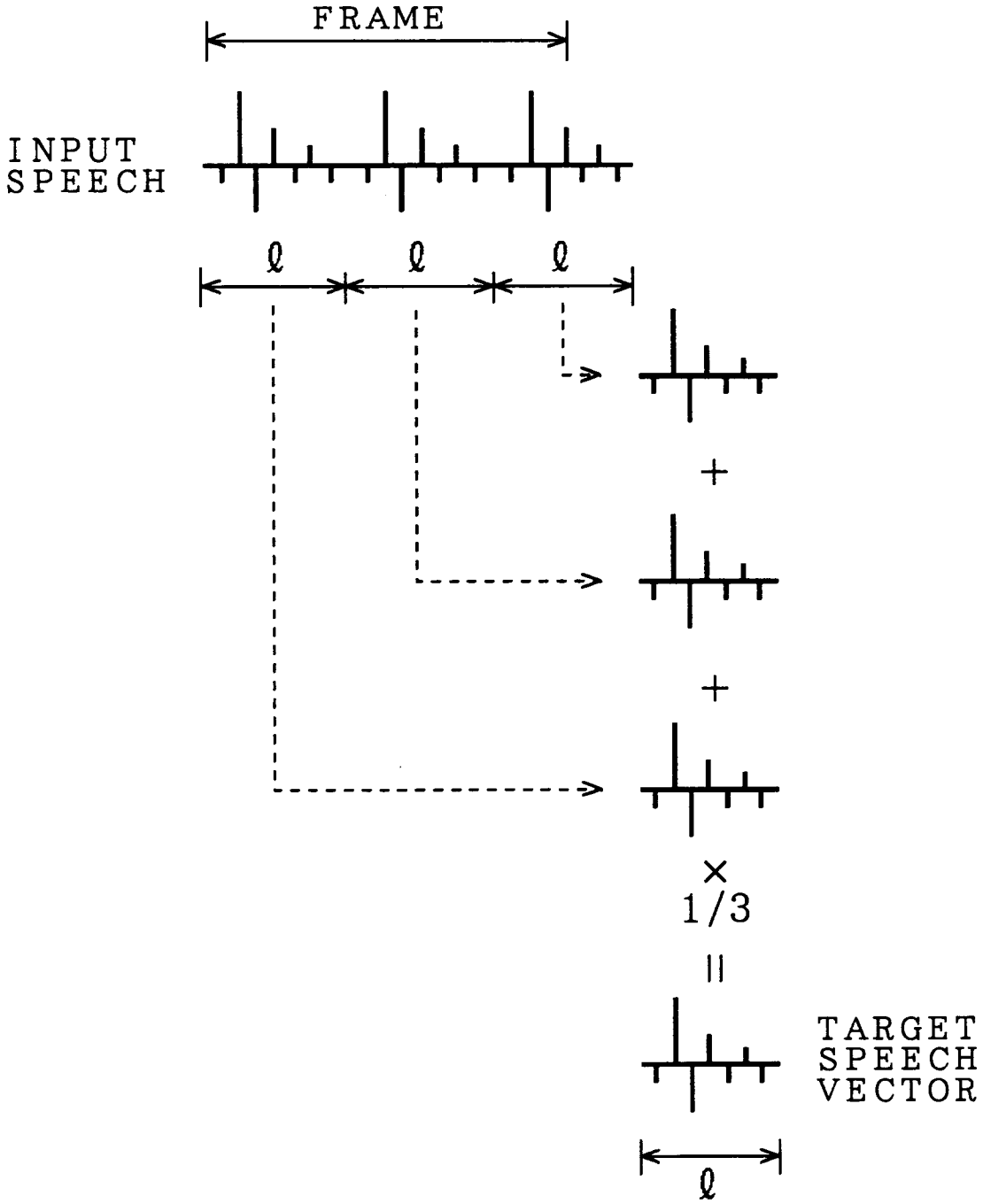
FIG. 3 is an explanatory view showing how target speech generation means of a fifth embodiment of the invention typically operates.

In the first embodiment, as described, the target speech generation means 28 generates the target speech vector of the vector length corresponding to the delay parameter l on the basis of the input speech of the frame length. Alternatively, as shown in FIG. 3, a fifth embodiment of the invention may generate the target speech vector from the input speech having the length of an integer multiple of the vector length corresponding to the delay parameter l.

The fifth embodiment simplifies the averaging process during generation of the target speech vector by eliminating the need for dealing with vectors with different vector lengths. In the evaluating process during encoding of an input speech having a length exceeding the frame length, the fifth embodiment determines the code by taking into account how the synthesis speech of a given frame affects the subsequent frames. This feature improves the reproducibility of the synthesis speech and enhances the quality thereof.

Sixth Embodiment

Figure 4:
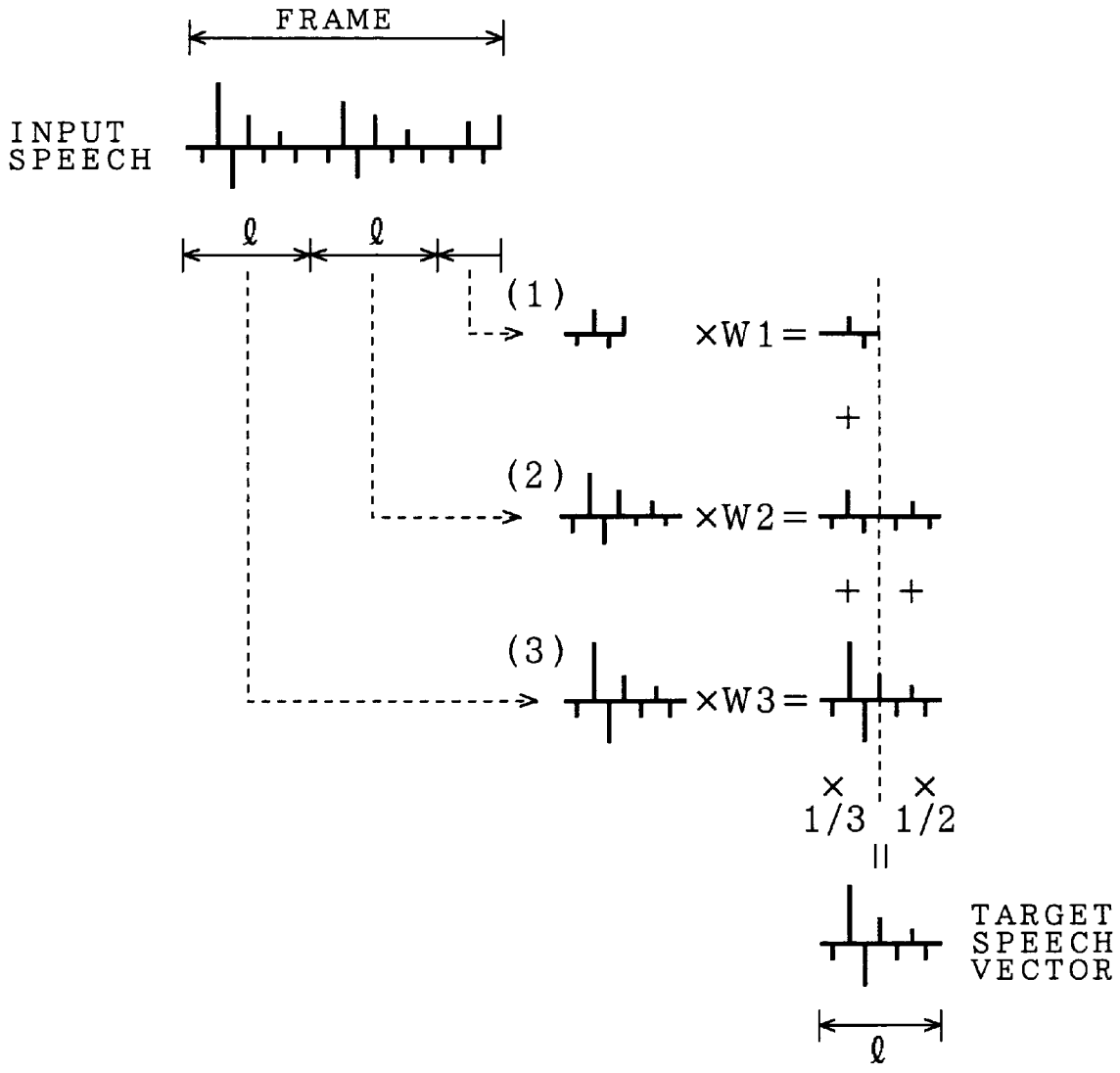
FIG. 4 is an explanatory view indicating how target speech generation means of a sixth embodiment of the invention typically operates.

In the first embodiment, as described, the target speech generation means 28 computes a simple mean of the input speech when generating the target speech vector of the vector length corresponding to the delay parameter l. Alternatively, as depicted in FIG. 4, a sixth embodiment of the invention may compute a weighted mean of the input speech in a way that the higher the power level of the input speech portions with the vector lengths each corresponding to the delay parameter l, the greater the weight on these portions.

In the averaging process during generation of the target speech vector, the sixth embodiment encodes the input speech by applying a greater weight to those portions of the input speech which have high levels of power. This feature improves the reproducibility of those portions of the synthesis speech which have high levels of power and thus affect the subjective quality of the speech significantly, whereby the quality of the synthesis speech is enhanced.

Seventh Embodiment

Figure 5:
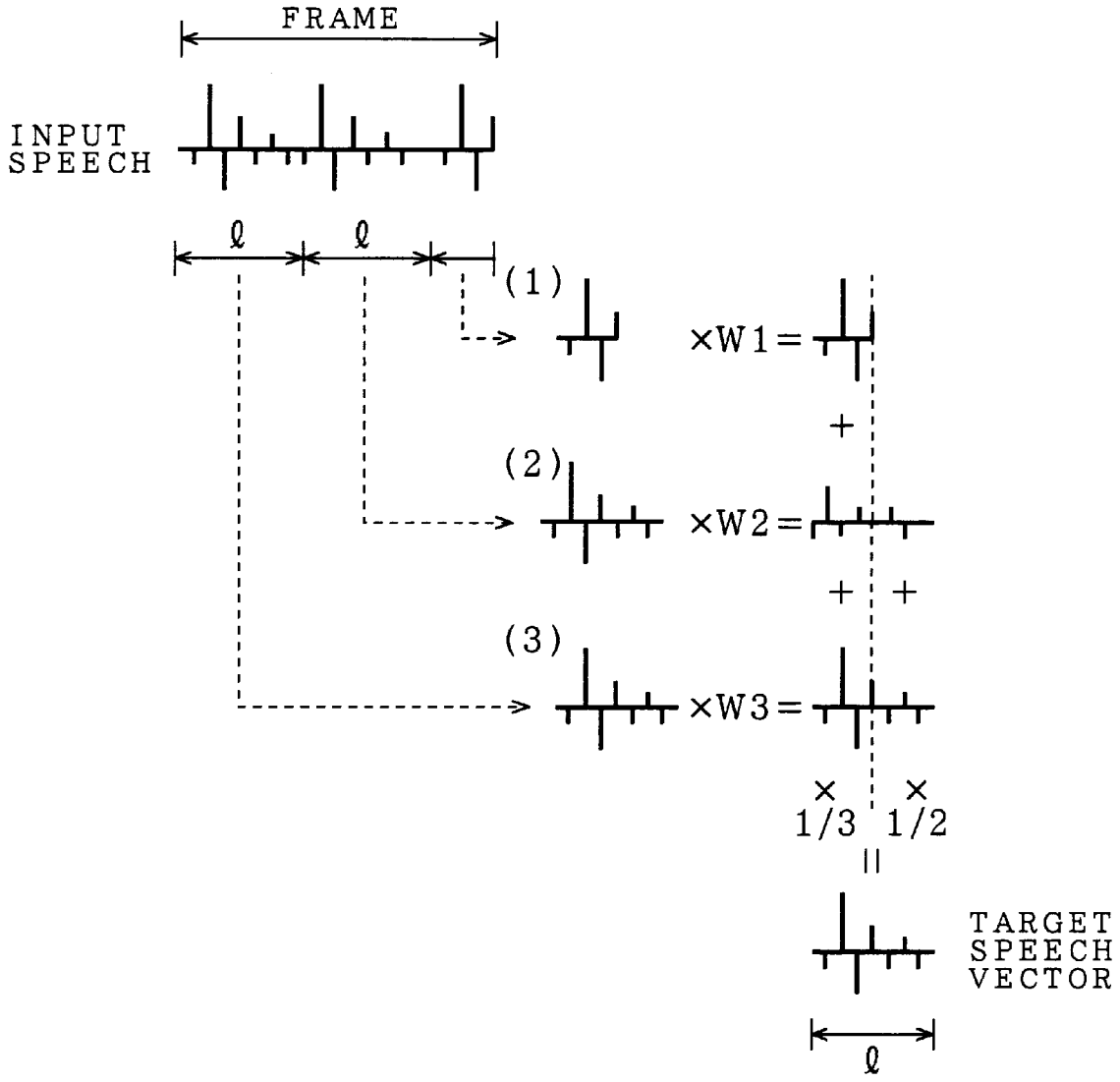
FIG. 5 is an explanatory view sketching how target speech generation means of a seventh embodiment of the invention typically operates.

In the first embodiment, as described, the target speech generation means 28 computes a simple mean of the input speech when generating the target speech vector of the vector length corresponding to the delay parameter l. Alternatively, as illustrated in FIG. 5, a seventh embodiment of the invention may compute a weighted mean of the input speech in a way that the lower the level of correlation between the input speech portions having the vector lengths each corresponding to the delay parameter l, the smaller the weight on these portions.

In the averaging process during generation of the target speech vector, the seventh embodiment encodes the input speech by reducing the weight of the input speech portions having low levels of correlation therebetween where the input speech is periodical at intervals of l. This feature makes it possible, given an input speech with a variable pitch period, to generate a target speech vector with a limited distortion at the pitch period, whereby the reproducibility of the synthesis speech is improved and the quality thereof enhanced.

Eighth Embodiment

Figure 6:
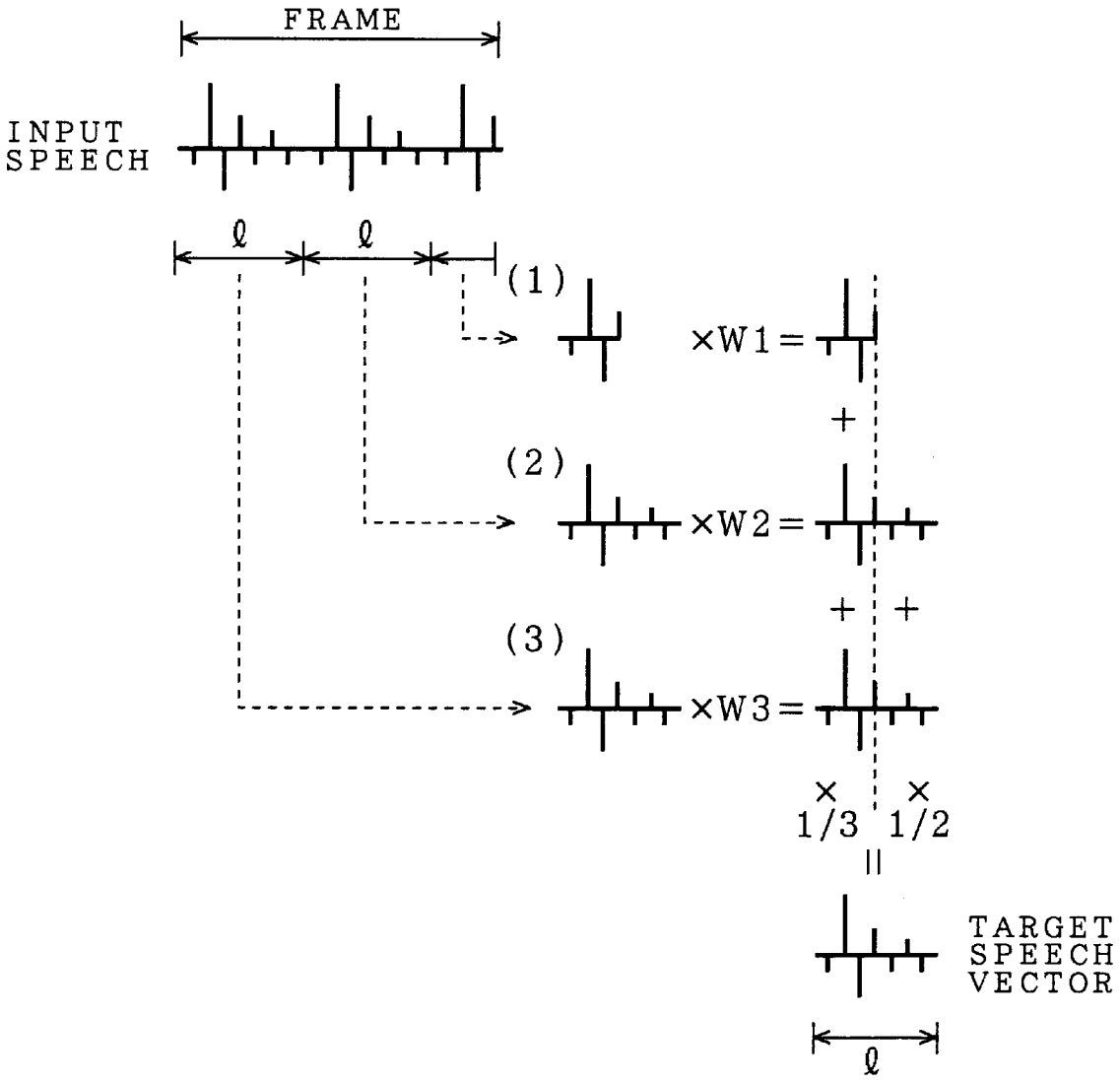
FIG. 6 is an explanatory view picturing how target speech generation means of an eighth embodiment of the invention typically operates.

In the first embodiment, as described, the target speech generation means 28 computes a simple mean of the input speech when generating the target speech vector of the vector length corresponding to the delay parameter l. Alternatively, as shown in FIG. 6, an eighth embodiment of the invention may compute a weighted mean of the input speech in a way that, given the input speech portions having the vector lengths each corresponding to the delay parameter l, the closer the input speech portions to the frame boundary, the greater the weight on these portions.

In the averaging process during generation of the target speech vector, the eighth embodiment encodes the input speech and generates the target speech vector by increasing the weight on the input speech portions positioned close to the frame boundary. This feature improves the reproducibility of the synthesis speech near the frame boundary and thereby smoothes out changes in the synthesis speech between frames. The benefits are particularly evident when the excitation signal in the second embodiment is generated through interpolation between frames.

Ninth Embodiment

Figure 7:
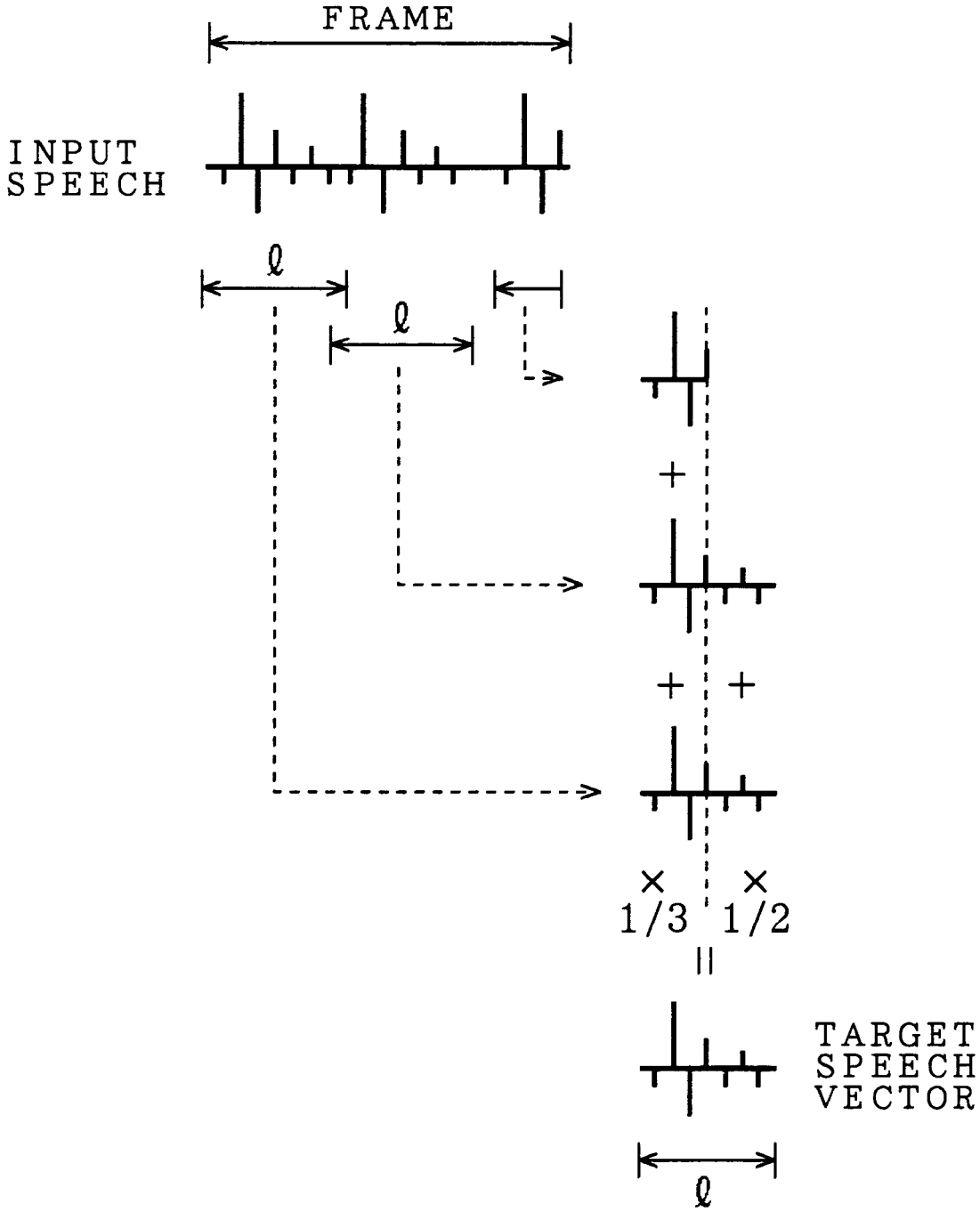
FIG. 7 is an explanatory view presenting how target speech generation means of a ninth embodiment of the invention typically operates.
Figure 9:
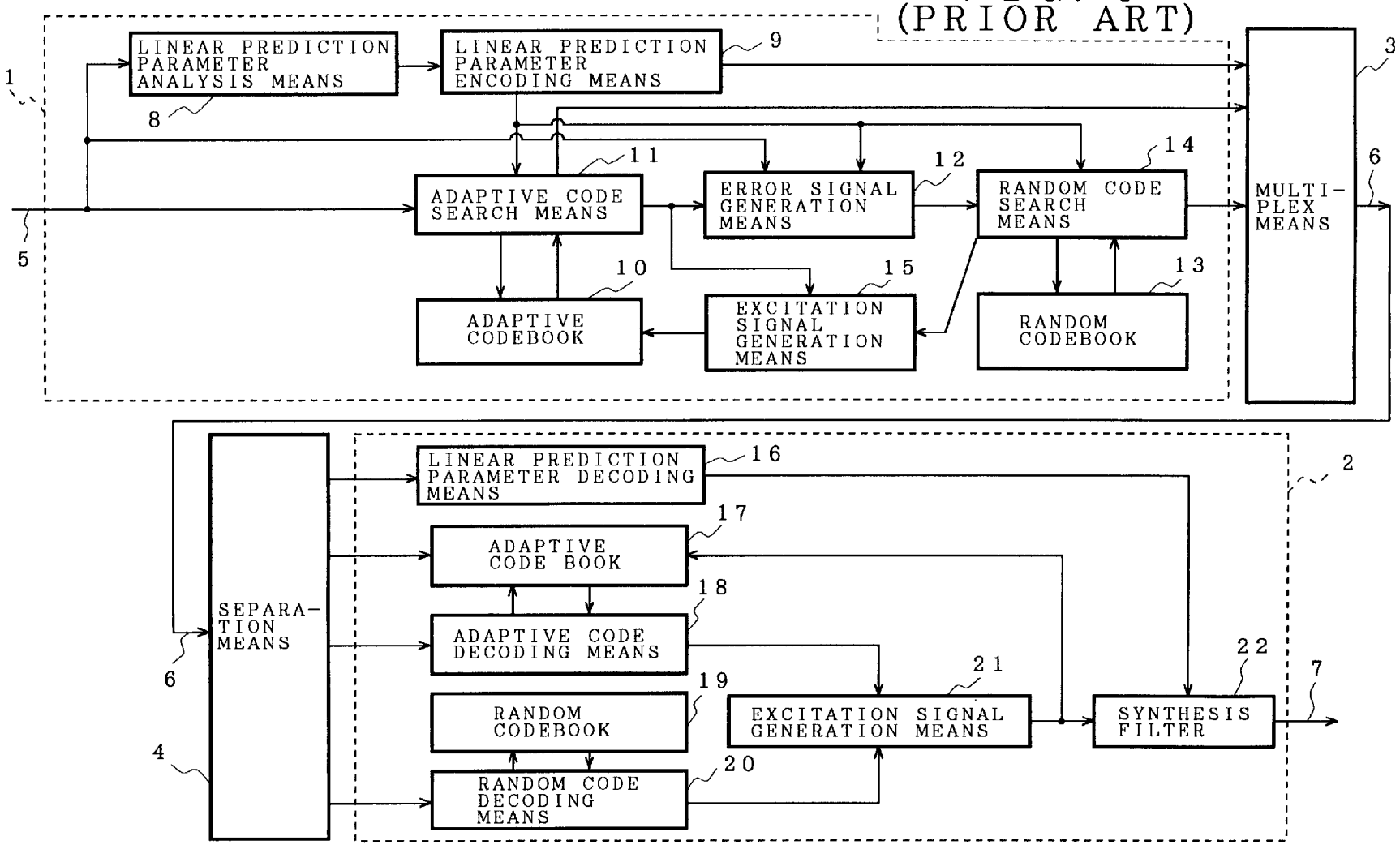
FIG. 9 (PRIOR ART)
FIG. 9 is a block diagram illustrating the overall constitution of a conventional speech encoding and decoding apparatus.
Figure 10A:
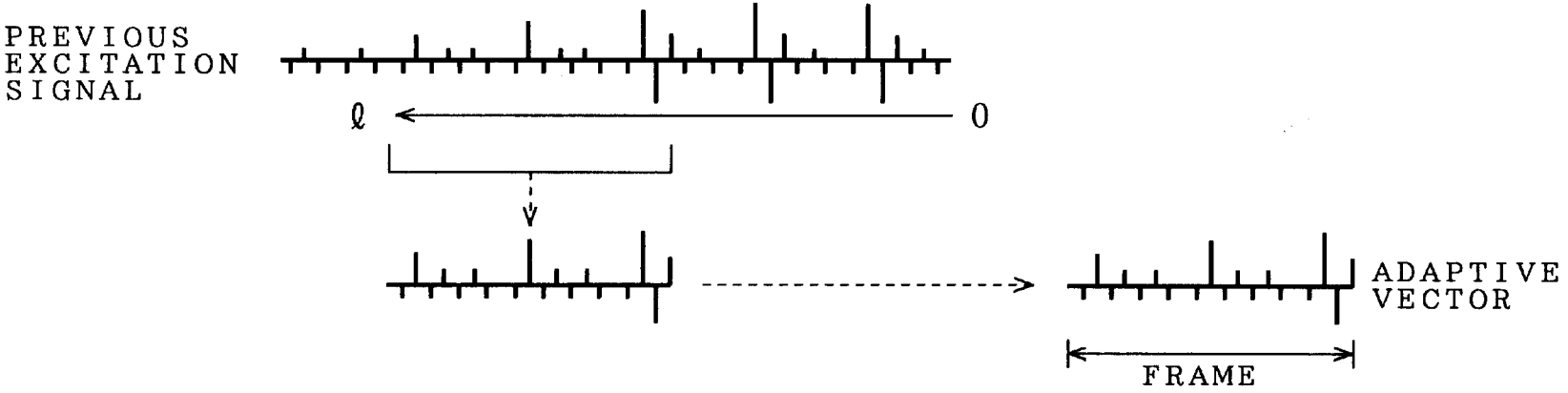
FIG. 10(a) (PRIOR ART)
FIGS. 10(*a*) and 10(*b*) are explanatory views depicting typical adaptive vectors used by the conventional speech encoding and decoding apparatus.
Figure 10B:
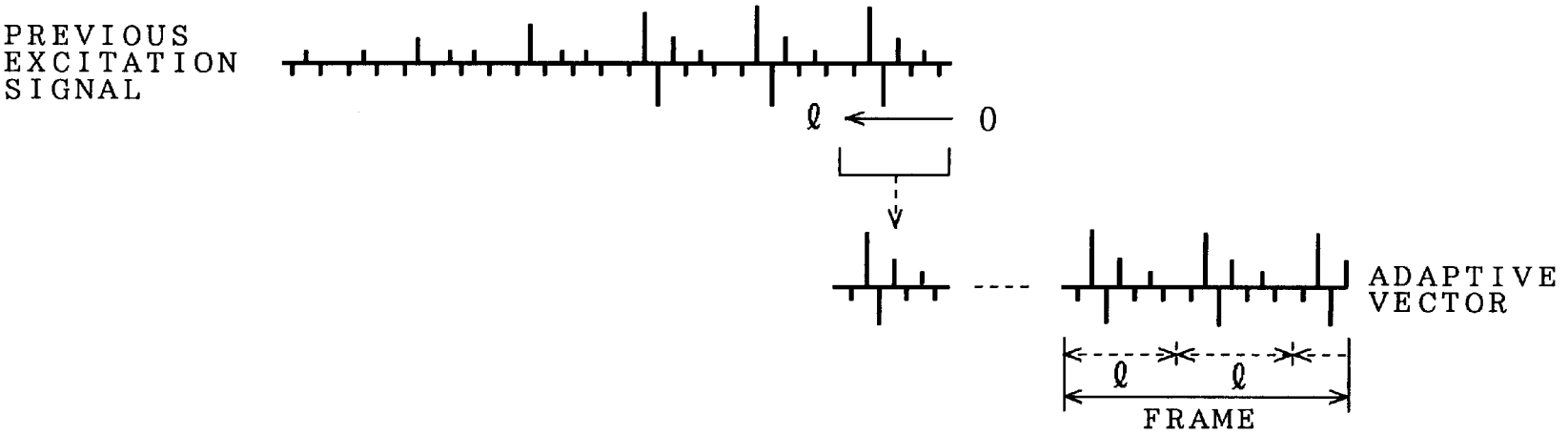
FIG. 10(b) (PRIOR ART)
Figure 11:
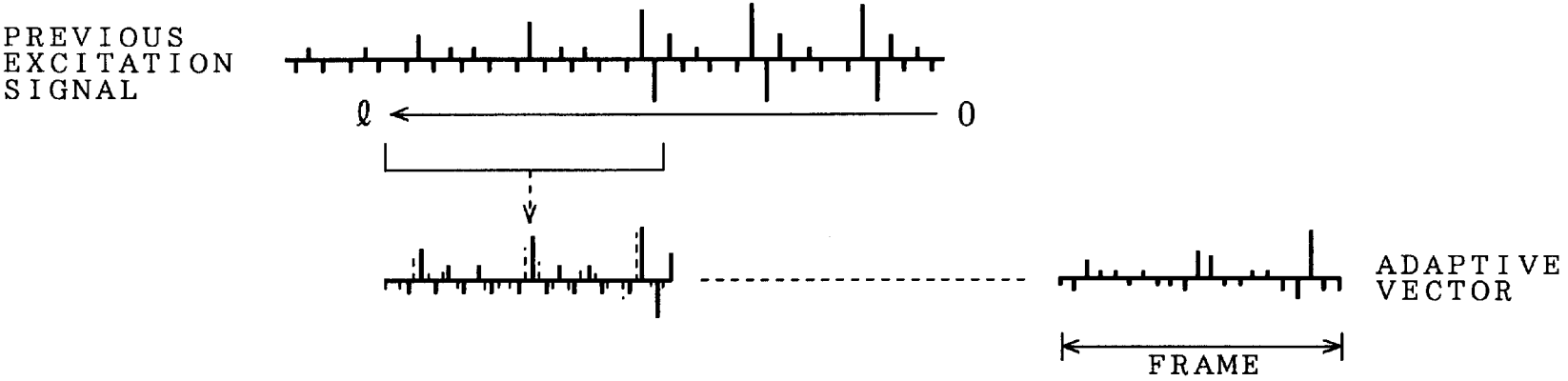
FIG. 11 (a) (PRIOR ART)
FIGS. 11(*a*) and 11(*b*) are explanatory views indicating typical adaptive vectors used by an improved conventional speech encoding and decoding apparatus.
Figure 11:
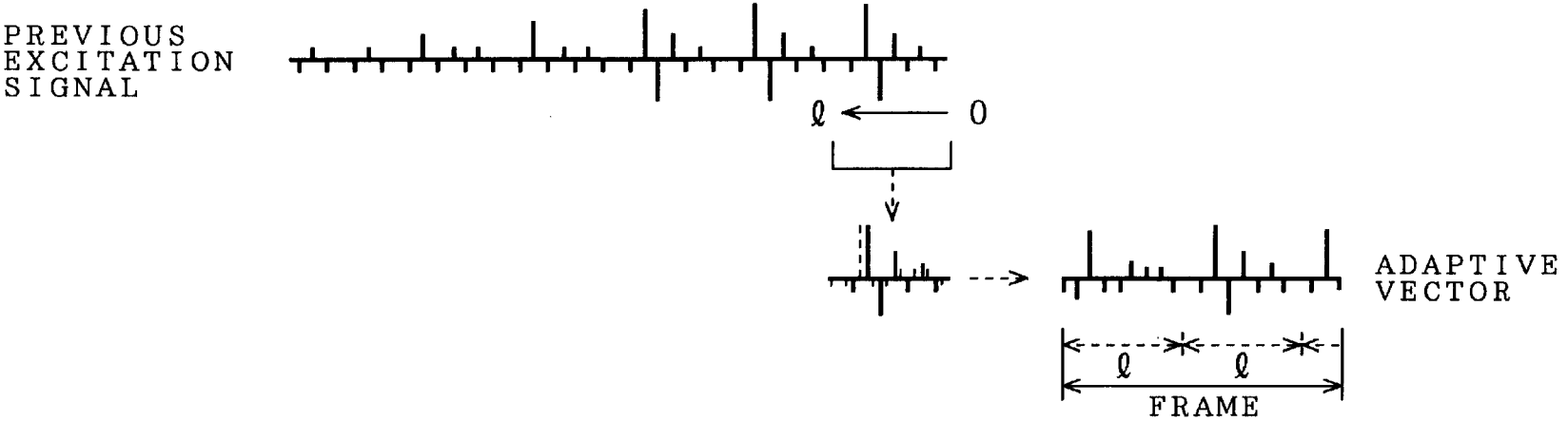
FIG. 11 (b) (PRIOR ART)

In the first embodiment, as described, the target speech generation means 28 computes a weighted mean of the input speech at intervals of l when generating the target speech vector of the vector length corresponding to the delay parameter l. Alternatively, as depicted in FIG. 7, a ninth embodiment of the invention may compute a weighted mean of the input speech while fine-adjusting the position from which to extract the input speech in such a manner that the correlation between the input speech portions having the vector lengths each corresponding to the delay parameter l is maximized.

In the averaging process during generation of the target speech vector, the ninth embodiment fine-adjusts the input speech extracting position so that the correlation between the input speech portions having the vector lengths each corresponding to the delay parameter l will be maximized. This feature makes it possible, given an input speech with a variable pitch period, to generate a target speech vector with a limited distortion at the pitch period, whereby the reproducibility of the synthesis speech is improved and the quality thereof enhanced.

Tenth Embodiment

FIG. 8 is a block diagram showing the overall constitution of a speech encoding apparatus and a speech decoding apparatus practiced as the tenth embodiment of the invention. In FIG. 8, those parts with their counterparts already shown in FIG. 1 are given the same reference numerals, and descriptions of these parts are omitted where they are repetitive.

The constitution of FIG. 8 comprises the following new components that are not included in FIG. 1: input speech up-sampling means 44 that up-samples the input speech; target speech generation means 45 that generates a target speech vector of a vector length corresponding to the pitch period; random codebooks 46 and 51 that output a random vector of the vector length corresponding to the pitch period; random code search means 47 that evaluates the distortion of a synthesis vector obtained from the random vector with respect to the target speech vector, in order to find the random vector conducive to the least distortion; second target speech generation means 48 that generates a target speech vector of the vector length corresponding to the pitch period in a search for a second random vector; second random codebooks 49 and 54 that output a second random vector of the vector length corresponding to the pitch period; second random code search means 50 that evaluates the distortion of a synthesis vector obtained from the second random vector with respect to the second target speech vector, in order to find the random vector conducive to the least distortion; random code decoding means 52 that decodes the random excitation signal of the vector length corresponding to the pitch period; frame excitation generation means 53 that generates the random excitation signal of a frame length from the random excitation signal of the vector length corresponding to the pitch period; second random code decoding means 55 that decodes the second random excitation signal having the vector length corresponding to the pitch period; and second frame excitation generation means 56 that generates the random excitation signal of the frame length from the second random excitation signal of the vector length corresponding to the pitch period.

How the tenth embodiment operates will now be described with the emphasis on the operations of its new components.

In the encoder 1, the pitch analysis means 25 analyzes the input speech 5 to extract the pitch period P therefrom. The extracted pitch period P is output to the multiplex means 3, input speech up-sampling means 44, target speech generation means 45, random codebook 46 and second random codebook 49. The pitch period P may be an integer as well as a fractional rational number. The pitch period P may be any one of the following values where P int means integer value. If P<45, the pitch is any one of "P int," "P int+¼," "P int+½" and "P int+¾"; if 45≦P<65, the pitch is "P int" or "P int+½"; if 65≦P, the pitch is "P int."

The input speech up-sampling means 44 up-samples the input speech 5 at a sampling rate corresponding to the pitch period received from the pitch analysis means 25 in the frame illustratively. The up-sampled input speech is output to the target speech generation means 45. The up-sampling rate is determined illustratively as follows: if P<45, the up-sampling is performed at a rate four times as high; if 45≦P<65, the up-sampling is conducted at a rate twice as high; if 65≦P, the up-sampling is not carried out.

On receiving the up-sampled input speech of a frame length from the input speech up-sampling means 44, the target speech generation means 45 computes a weighted mean of the input speech illustratively at intervals of P corresponding to the pitch period P received from the pitch analysis means 25, in order to generate a target speech vector of a vector length P. The generated target speech vector is output to the random code search means 47 and second target speech generation means 48. If the vector length P is equal to or greater than the frame length, no weighted mean is computed, and the input speech of the frame length is regarded as the target speech vector.

The random codebook 46 holds as many as N random vectors generated illustratively from random noise. The random codebook 46 extracts and outputs, by the vector length corresponding to the pitch period P from the pitch period means 25, the random vector corresponding to the random code i received from the random code search means 47. If the pitch period P is equal to or greater than the frame length, the random vector of the frame length is output.

The random code search means 47 receives any one of the N random vectors extracted from the random codebook 46, accepts the quantized linear prediction parameter from the linear prediction parameter encoding means 9, and generates a synthesis vector by linear prediction with the received random vector and the quantized linear prediction parameter. The random code search means 47 then obtains the perceptual weighted distortion of the synthesis vector with respect to the target speech vector received from the target speech generation means 45. Evaluating the distortion through comparison, the random code search means 47 finds the random code I and the random gain $\gamma$ conducive to the least distortion. The random code I and a code representing the random gain $\gamma$ are output to the multiplex means 3. At the same time, the random code search mean 47 generates a random excitation signal by multiplying the random vector corresponding to the random code I by the random gain $\gamma$.

The random excitation signal thus generated is output to the second target speech generation means 48.

The second target speech generation means 48 receives the random excitation signal from the random code search means 47, accepts the quantized linear prediction parameter from the linear prediction parameter encoding means 9, and generates a synthesis vector by linear prediction with the random excitation signal and the quantized linear prediction parameter. The second target speech generation means 48 then acquires the difference between the target speech vector from the target speech generation means 45 on the one hand, and the synthesis vector on the other. The difference thus acquired is output as a second target speech vector to the second random code search means 50.

The second random codebook 49 holds as many as N random vectors generated illustratively from random noise. The second random codebook 49 extracts and outputs, by the vector length corresponding to the pitch period P received from the pitch analysis means 25, the second random vector corresponding to a random code j received from the second random code search means 50. If the pitch period P is equal to or greater than the frame length, the random vector of the frame length is output.

The second random code search means 50 receives any one of the N random vectors extracted as the second random vector from the second random codebook 49, accepts the quantized linear prediction parameter from the linear prediction parameter encoding means 9, and generates a synthesis vector by linear prediction with the received random vector and the quantized linear prediction parameter. The second random code search means 50 then obtains the perceptual weighted distortion of the synthesis vector with respect to the second target speech vector received from the second target speech generation means 48. Evaluating the distortion through comparison, the second random code search means 50 acquires the second random code J and the second random gain γ2 conducive to the least distortion. The second random code J and a code representing the second random gain γ2 are output to the multiplex means 3.

When the encoding process above is completed, the multiplex means 3 outputs onto the transmission line 6 the code representing the quantized linear prediction parameter, the pitch period P, the random excitation signals I and J, and the codes representing the excitation gains γ and γ2.

The operations described above characterize the encoder 1 of the tenth embodiment. What follows is a description of how the decoder 2 of the same embodiment illustratively operates.

On receiving the output of the multiplex means 3, the separation means 4 outputs through a separating process the code of the linear prediction parameter to the linear prediction parameter decoding means 16, the pitch period P to the random codebook 51 and second random codebook 54, the random code I and the code of the random gain γ to the random code decoding means 52, and the second random code J and the code of the second random gain γ2 to the second random code decoding means 55.

Like the random codebook 46 on the encoder side, the random codebook 51 holds as many as N random vectors. From these vectors, the random vector corresponding to the random code I received from the random code decoding means 52 is extracted in the vector length corresponding to the pitch period P. The random vector thus obtained is output to the random code decoding means 52.

The random code decoding means 52 decodes the code of the random gain γ back to the random gain γ, and generates a random excitation signal by multiplying the extracted random vector from the random codebook 51 by the random gain γ. The random excitation signal thus generated is output to the frame excitation generation means 53. Given the random excitation signal from the random code decoding means 52, the frame excitation generation means 53 repeats the received signal illustratively at intervals of P to generate a periodical random excitation signal of the frame length. The generated random excitation signal of the frame length is output to the excitation signal generation means 21.

Like the second random codebook 49 on the encoder side, the second random codebook 54 holds as many as N random vectors. From these vectors, the second random vector corresponding to the second random code J received from the second random code decoding means 55 is extracted in the vector length corresponding to the pitch period P. The second random vector thus obtained is output to the second random code decoding means 55.

The second random code decoding means 55 decodes the code of the second random gain γ2 back to the second random gain γ2, and generates a second random excitation signal by multiplying the extracted second random vector from the second random codebook 54 by the random gain γ2. The second random excitation signal thus generated is output to the second frame excitation generation means 56. Given the second random excitation signal from the second random code decoding means 55, the second frame excitation generation means 56 repeats the received signal illustratively at intervals of P to generate a periodical second random excitation signal of the frame length. The generated second random excitation signal of the frame length is output to the excitation signal generation means 21.

The excitation signal generation means 21 receives the random excitation signal of the frame length from the frame excitation generation means 53, accepts the second random excitation signal of the frame length from the second frame excitation generation means 56, and adds up the two inputs to generate an excitation signal. The excitation signal thus generated is output to the synthesis filter 22. The synthesis filter 22 receives the excitation signal from the excitation signal generation means 21 as well as the linear prediction parameter from the linear prediction parameter decoding means 16, and provides the output speech 7 by linear prediction with the two inputs.

The operations described above characterize the decoder 2 of the tenth embodiment.

According to the tenth embodiment, when the pitch period P of the input speech is shorter than the frame length, a weighted mean is effected to the signal periodically extracted from an input speech to generate the target speech vector of the vector length P. Then, the synthesis vector is generated by linear prediction with the random vector of the vector length P and the target speech vector of the vector length P, the distortion of the synthesis vector is obtained and evaluated with respect to the target speech vector. These operations make it possible to avert the deterioration of synthesis speech quality and to generate a synthesis speech of high quality with small amounts of computations.

As described above in detail, the speech encoding apparatus according to the invention typically comprises: target speech generation means for generating from the input speech a target speech vector of a vector length corresponding to a delay parameter; an adaptive codebook for generating from previously generated excitation signals an adaptive vector of the vector length corresponding to the delay parameter; adaptive code search means for evaluating the distortion of a synthesis vector obtained from the adaptive vector with respect to the target speech vector so as to search for the adaptive vector conducive to the least distortion; and frame excitation generation means for generating an excitation signal of a frame length from the adaptive vector conducive to the least distortion. The apparatus of the above constitution averts the deterioration of synthesis speech quality and generates a synthesis speech of high quality with small amounts of computations.

In a preferred structure of the speech encoding apparatus according to the invention, the vector length of the target speech vector is a rational number. The structure of the apparatus makes it possible, upon generation of a target speech vector from the input speech, to generate the target speech vector accurately irrespective of the sampling rate of the input speech. This contributes to averting the deterioration of synthesis speech quality and generating a synthesis speech of high quality with small amounts of computations.

In another preferred structure of the speech encoding apparatus according to the invention, the target speech generation means divides an input speech having the length of an integer multiple of the vector length corresponding to the delay parameter, into portions each having the vector length, and computes a weighted mean of the input speech portions so as to generate the target speech vector. The apparatus simplifies the averaging process during generation of the target speech vector by eliminating the need for dealing with vectors with different vector lengths. This also contributes to avert the deterioration of synthesis speech quality and generating a synthesis speech of high quality with small amounts of computations.

In a further preferred structure of the speech encoding apparatus according to the invention, the length of the integer multiple of the vector length in which to generate the target speech vector is equal to or greater than the frame length. In the evaluating process during encoding of an input speech having a length exceeding the frame length, the apparatus determines the code by taking into account how the synthesis speech of a given frame affects the subsequent frames. This feature improves the reproducibility of the synthesis speech and enhances the quality thereof.

In an even further preferred structure of the speech encoding apparatus according to the invention, the characteristic quantity of the input speech portions each having the vector length includes at least power information about the input speech. The apparatus encodes the input speech by applying a greater weight to those portions of the input speech which have high levels of power. This feature improves the reproducibility of those portions of the synthesis speech which have high levels of power and thus affect the subjective quality of the speech significantly, whereby the quality of the synthesis speech is enhanced.

In a still further preferred structure of the speech encoding apparatus according to the invention, the characteristic quantity of the input speech portions each having the vector length includes at least correlative information about the input speech. Where the input speech has the pitch period l, the apparatus encodes the speech by reducing the weight on those input speech portions which have low correlation therebetween. The operation generates the target speech vector with the least distortion at the pitch period whenever the input speech has a variable pitch period. This feature also improves the reproducibility of the synthesis speech and enhances the quality thereof.

In a yet further preferred structure of the speech encoding apparatus according to the invention, the target speech generation means computes a weighted mean of the input speech by the vector length in accordance with the temporal relationship of the input speech portions each having the vector length, thereby determining the weight for generating the target speech vector. The apparatus encodes the input speech and generates the target speech vector by increasing the weight on the input speech portions positioned close to the frame boundary. This feature improves the reproducibility of the synthesis speech near the frame boundary and thereby smoothes out changes in the synthesis speech between frames.

In another preferred structure of the speech encoding apparatus according to the invention, the target speech generation means fine-adjusts the temporal relationship of the input speech by the vector length when computing a weighted mean of the input speech portions each having the vector length. The apparatus fine-adjusts the input speech extracting position so that the correlation between the input speech portions each having the vector length l will be maximized. This feature makes it possible, given an input speech with a variable pitch period, to generate a target speech vector with a limited distortion at the pitch period, whereby the reproducibility of the synthesis speech is improved and the quality thereof enhanced.

In a further preferred structure of the speech encoding apparatus according to the invention, the frame excitation generation means interpolates between frames the excitation vector of the vector length, thereby generating the excitation signal. The apparatus smoothes out changes in the excitation signal between frames, whereby the reproducibility of the synthesis speech is improved and the quality thereof enhanced.

It is to be understood that while the invention has been described in conjunction with specific embodiments, it is evident that many alternatives, modifications and variations will become apparent to those skilled in the art in light of the foregoing description. Accordingly, it is intended that the present invention embrace all such alternatives, modifications and variations as fall within the spirit and scope of the appended claims.

What is claimed is:

1. A speech encoding apparatus for dividing an input speech into spectrum envelope information and excitation signal information and for encoding said excitation signal information by the frame, said speech encoding apparatus comprising:

target speech generation means for generating from said input speech a target speech vector of a vector length corresponding to a delay parameter;

an adaptive codebook for generating from previously generated excitation signals an adaptive vector of said vector length corresponding to said delay parameter;

adaptive code search means for evaluating the distortion of a synthesis vector obtained from said adaptive vector with respect to said target speech vector so as to search for an adaptive vector conducive to the least distortion; and frame excitation generation means for generating an excitation signal of a frame length from said adaptive vector conducive to the least distortion, wherein said vector length of said target speech vector and said vector length of said adaptive vector are less than said frame length.

2. A speech encoding apparatus according to claim 1, further comprising:

second target speech generation means for generating a second target speech vector from said target speech vector and said adaptive vector conducive to the least distortion;

a random codebook for generating a random vector of said vector length corresponding to said delay parameter;

random code search means for evaluating the distortion of a second synthesis vector obtained from said random vector with respect to said second target speech vector so as to search for the random vector conducive to the least distortion; and second frame excitation generation means for generating a second excitation signal of the frame length from said random vector conducive to the least distortion.

3. A speech encoding apparatus for dividing an input speech into spectrum envelope information and excitation signal information and for encoding said excitation signal information by the frame, said speech encoding apparatus comprising:

target speech generation means for generating from said input speech a target speech vector of a vector length corresponding to a delay parameter;

a random codebook for generating a random vector of said vector length corresponding to said delay parameter;

random code search means for evaluating the distortion of a synthesis vector obtained from said random vector with respect to said target speech vector so as to search for a random vector conducive to the least distortion; and frame excitation generation means for generating an excitation signal of a frame length from said random vector conducive to the least distortion, wherein said vector length of said target speech vector and said vector length of said random vector are less than said length.

4. A speech encoding apparatus according to claim 3, wherein said delay parameter is determined in accordance with the pitch period of said input speech.

5. A speech encoding apparatus according to claim 1, wherein said vector length corresponding to said delay parameter is a rational number.

6. A speech encoding apparatus according to claim 1, wherein said target speech generation means divides an input speech in a frame into portions each having said vector length corresponding to said delay parameter, and computes a weighted mean of the input speech portions each having said vector length so as to generate said target speech vector.

7. A speech encoding apparatus according to claim 1, wherein said target speech generation means divides an input speech having the length of an integer multiple of said vector length corresponding to said delay parameter, into portions each having said vector length, and computes a weighted mean of the input speech portions so as to generate said target speech vector.

8. A speech encoding apparatus according to claim 7, wherein said length of the integer multiple of said vector length corresponding to said delay parameter is equal to or greater than said frame length.

9. A speech encoding apparatus according to claim 6, wherein said target speech generation means computes a weighted mean of said input speech by said vector length in accordance with the characteristic quantity of said input speech portions each having said vector length corresponding to said delay parameter, thereby determining the weight for generating said target speech vector.

10. A speech encoding apparatus according to claim 9, wherein said characteristic quantity of said input speech portions each having said vector length corresponding to said delay parameter includes at least power information about said input speech.

11. A speech encoding apparatus according to claim 9, wherein said characteristic quantity of said input speech portions each having said vector length corresponding to said delay parameter includes at least correlative information about said input speech.

12. A speech encoding apparatus according to claim 6, wherein said target speech generation means computes a weighted mean of said input speech by said vector length in accordance with the temporal relationship of said input speech portions each having said vector length corresponding to said delay parameter, thereby determining the weight for generating said target speech vector.

13. A speech encoding apparatus according to claim 6, wherein said target speech generation means fine-adjusts the temporal relationship of said input speech by said vector length when computing a weighted mean of said input speech portions each having said vector length corresponding to said delay parameter.

14. A speech encoding apparatus according to claim 1, wherein said frame excitation generation means repeats at intervals of said vector length the excitation vector of said vector length corresponding to said delay parameter in order to acquire a periodical excitation vector, thereby generating said excitation signal of said frame length.

15. A speech encoding apparatus according to claim 1, wherein said frame excitation generation means interpolates between frames the excitation vector of said vector length corresponding to said delay parameter, thereby generating said excitation signal.

16. A speech encoding apparatus according to claim 1, wherein said adaptive code search means includes a synthesis filter and uses an impulse response from said synthesis filter to compute repeatedly the distortion of said synthesis vector obtained from said adaptive vector with respect to said target speech vector.

17. A speech encoding apparatus according to claim 5, further comprising input speech up-sampling means for up-sampling said input speech, wherein said target speech generation means generates said target speech vector from the up-sampled input speech.

18. A speech encoding apparatus according to claim 5, further comprising excitation signal up-sampling means for up-sampling previously generated excitation signals, wherein said adaptive codebook generates said adaptive vector from the up-sampled previously generated excitation signals.

19. A speech encoding apparatus according to claim 17, wherein said input speech up-sampling means changes the up-sampling rate of the up-sampling operation in accordance with said delay parameter.

20. A speech encoding apparatus according to claim 17, wherein said input speech up-sampling means changes the up-sampling rate of the up-sampling operation on either the input speech or the excitation signal only within a range based on said vector length corresponding to said delay parameter.

21. A speech encoding and decoding apparatus for dividing an input speech into spectrum envelope information and excitation signal information, encoding said excitation signal information by the frame, and decoding the encoded excitation signal information so as to generate an output speech, the encoding side of said speech encoding and decoding apparatus comprising:

target speech generation means for generating from said input speech a target speech vector of a vector length corresponding to a delay parameter;

an adaptive codebook for generating from previously generated excitation signals an adaptive vector of said vector length corresponding to said delay parameter;

adaptive code search means for evaluating the distortion of a synthesis vector obtained from said adaptive vector with respect to said target speech vector so as to search for an adaptive vector conducive to the least distortion; and frame excitation generation means for generating an excitation signal of a frame length from said adaptive vector conducive to the least distortion;

the decoding side of said speech encoding and decoding apparatus comprising:

an adaptive codebook for generating said adaptive vector of said vector length corresponding to said delay parameter; and frame excitation generation means for generating said excitation signal of said frame length from said adaptive vector, wherein said vector length of said target speech vector and said vector length of said adaptive vector are less than said frame length.

22. A speech encoding and decoding apparatus according to claim 21, wherein said encoding side further comprises:

second target speech generation means for generating a second target speech vector from said target speech vector and said adaptive vector;

a random codebook for generating a random vector of said vector length corresponding to said delay parameter;

random code search means for evaluating the distortion of a second synthesis vector obtained from said random vector with respect to said second target speech vector so as to search for the random vector conducive to the least distortion; and second frame excitation generation means for generating a second excitation signal of the frame length from said random vector conducive to the least distortion; and wherein said decoding side further comprises:

a random codebook for generating said random vector of said vector length corresponding to said delay parameter; and second frame excitation generation means for generating said second excitation signal of said frame length from said random vector.

23. A speech encoding and decoding apparatus for dividing an input speech into spectrum envelope information and excitation signal information, encoding said excitation signal information by the frame, and decoding the encoded excitation signal information so as to generate an output speech, the encoding side of said speech encoding and decoding apparatus comprising:

target speech generation means for generating from said input speech a target speech vector of a vector length corresponding to a delay parameter;

a random codebook for generating a random vector of said vector length corresponding to said delay parameter;

random code search means for evaluating the distortion of a synthesis vector obtained from said random vector with respect to said target speech vector so as to search for a random vector conducive to the least distortion; and frame excitation generation means for generating an excitation signal of a frame length from said random vector conducive to the least distortion;

the decoding side of said speech encoding and decoding apparatus comprising:

a random codebook for generating said random vector of said vector length corresponding to said delay parameter; and frame excitation generation means for generating said excitation signal of said frame length from said random vector, wherein said vector length of said target speech vector and said vector length of said random vector are less than said frame length.

24. A speech encoding apparatus for dividing an input speech into spectrum envelope information and excitation signal information and for encoding said excitation signal information by frame, said speech encoding apparatus comprising:

an adaptive codebook for generating, from previously generated excitation signals of a frame length, an adaptive vector of a vector length corresponding to a delay parameter; and adaptive code search means for evaluating the distortion of a synthesis vector from said adaptive vector to determine an adaptive vector conducive to the least distortion of a vector length corresponding to a delay parameter conducive to the least distortion, wherein said vector length of said adaptive vector is less than said frame length, and said vector length of said adaptive vector conductive to the least distortion is less than said frame length.

25. A speech encoding apparatus for dividing an input speech into spectrum envelope information and excitation signal information and for encoding said excitation signal information by the frame, said speech encoding apparatus comprising:

target speech generation means for generating from said input speech a target speech vector of a vector length corresponding to a delay parameter;

an adaptive codebook for generating from previously generated excitation signals an adaptive vector of said vector length corresponding to said delay parameter;

adaptive code search means for evaluating the distortion of a synthesis vector obtained from said adaptive vector with respect to said target speech vector so as to search for an adaptive vector conducive to the least distortion; and frame excitation generation means for generating an excitation signal of a frame length from said adaptive vector conducive to the least distortion, wherein said target speech generation means divides an input speech in a frame into portions each having said vector length corresponding to said delay parameter, and computes a weighted mean of the input speech portions each having said vector length so as to generate said target speech vector.

26. A speech encoding apparatus according to claim 25, further comprising:

second target speech generation means for generating a second target speech vector from said target speech vector and said adaptive vector conducive to the least distortion;

a random codebook for generating a random vector of said vector length corresponding to said delay parameter;

random code search means for evaluating the distortion of a second synthesis vector obtained from said random vector with respect to said second target speech vector so as to search for the random vector conducive to the least distortion; and second frame excitation generation means for generating a second excitation signal of the frame length from said random vector conducive to the least distortion.

27. A speech encoding apparatus for dividing an input speech into spectrum envelope information and excitation signal information and for encoding said excitation signal information by the frame, said speech encoding apparatus comprising:

target speech generation means for generating from said input speech a target speech vector of a vector length corresponding to a delay parameter;

a random codebook for generating a random vector of said vector length corresponding to said delay parameter;

random code search means for evaluating the distortion of a synthesis vector obtained from said random vector with respect to said target speech vector so as to search for the random vector conducive to the least distortion; and frame excitation generation means for generating an excitation signal of a frame length from said random vector conducive to the least distortion, wherein said target speech generation means divides an input speech in a frame into portions each having said vector length corresponding to said delay parameter, and computes a weighted mean of the input speech portions each having said vector length so as to generate said target speech vector.

28. A speech encoding apparatus according to claim 27, wherein said delay parameter is determined in accordance with the pitch period of said input speech.

29. A speech encoding apparatus according to claim 25, wherein said vector length corresponding to said delay parameter is a rational number.

30. A speech encoding apparatus according to claim 25, wherein said target speech generation means divides an input speech having the length of an integer multiple of said vector length corresponding to said delay parameter, into portions each having said vector length, and computes a weighted mean of the input speech portions so as to generate said target speech vector.

31. A speech encoding apparatus according to claim 30, wherein said length of the integer multiple of said vector length corresponding to said delay parameter is equal to or greater than said frame length.

32. A speech encoding apparatus according to claim 25, wherein said target speech generation means computes a weighted mean of said input speech by said vector length in accordance with the characteristic quantity of said input speech portions each having said vector length corresponding to said delay parameter, thereby determining the weight for generating said target speech vector.

33. A speech encoding apparatus according to claim 32, wherein said characteristic quantity of said input speech portions each having said vector length corresponding to said delay parameter includes at least power information about said input speech.

34. A speech encoding apparatus according to claim 32, wherein said characteristic quantity of said input speech portions each having said vector length corresponding to said delay parameter includes at least correlative information about said input speech.

35. A speech encoding apparatus according to claim 25, wherein said target speech generation means computes a weighted mean of said input speech by said vector length in accordance with the temporal relationship of said input speech portions each having said vector length corresponding to said delay parameter, thereby determining the weight for generating said target speech vector.

36. A speech encoding apparatus according to claim 25, wherein said target speech generation means fine-adjusts the temporal relationship of said input speech by said vector length when computing a weighted mean of said input speech portions each having said vector length corresponding to said delay parameter.

37. A speech encoding apparatus according to claim 25, wherein said frame excitation generation means repeats at intervals of said vector length the excitation vector of said vector length corresponding to said delay parameter in order to acquire a periodical excitation vector, thereby generating said excitation signal of said frame length.

38. A speech encoding apparatus according to claim 25, wherein said frame excitation generation means interpolates between frames the excitation vector of said vector length corresponding to said delay parameter, thereby generating said excitation signal.

39. A speech encoding apparatus according to claim 25, wherein said adaptive code search means includes a synthesis filter and uses an impulse response from said synthesis filter to compute repeatedly the distortion of said synthesis vector obtained from said adaptive vector with respect to said target speech vector.

40. A speech encoding apparatus according to claim 29, further comprising input speech up-sampling means for up-sampling said input speech, wherein said target speech generation means generates said target speech vector from the up-sampled input speech.

41. A speech encoding apparatus according to claim 29, further comprising excitation signal up-sampling means for up-sampling previously generated excitation signals, wherein said adaptive codebook generates said adaptive vector form the up-sampled previously generated excitation signals.

42. A speech encoding apparatus according to claim 40, wherein said input speech up-sampling means changes the up-sampling rate of the up-sampling operation in accordance with said delay parameter.

43. A speech encoding apparatus according to claim 40, wherein said input speech up-sampling means changes the up-sampling rate of the up-sampling operation on either the input speech or the excitation signal only within a range based on said vector length corresponding to said delay parameter.

44. A speech encoding and decoding apparatus for dividing an input speech into spectrum envelope information and excitation signal information, encoding said excitation signal information by the frame, and decoding the encoded excitation signal information so as to generate an output speech, the encoding side of said speech encoding and decoding apparatus comprising:

target speech generation means for generating from said input speech a target speech vector of a vector length corresponding to a delay parameter;

an adaptive codebook for generating from previously generated excitation signals an adaptive vector of said vector length corresponding to said delay parameter;

adaptive code search means for evaluating the distortion of a synthesis vector obtained from said adaptive vector with respect to said target speech vector so as to search for an adaptive vector conducive to the least distortion; and frame excitation generation means for generating an excitation signal of a frame length from said adaptive vector conducive to the least distortion;

wherein said target speech generation means divides an input speech in a frame into portions each having said vector length corresponding to said delay parameter, and computes a weighted mean of the input speech portions each having said vector length so as to generate said target speech vector;

the decoding side of said speech encoding and decoding apparatus comprising:

an adaptive codebook for generating said adaptive vector of said vector length corresponding to said delay parameter; and frame excitation generation means for generating said excitation signal of said frame length from said adaptive vector.

45. A speech encoding and decoding apparatus according to claim 44, wherein said encoding side further comprises:

second target speech generation means for generating a second target speech vector from said target speech vector and said adaptive vector;

a random codebook for generating a random vector of said vector length corresponding to said delay parameter;

random code search means for evaluating the distortion of a second synthesis vector obtained from said random vector with respect to said second target speech vector so as to search for the random vector conducive to the least distortion; and second frame excitation generation means for generating a second excitation signal of the frame length from said random vector conducive to the least distortion; and wherein said decoding side further comprises:

a random codebook for generating said random vector of said vector length corresponding to said delay parameter; and second frame excitation generation means for generating said second excitation signal of said frame length from said random vector.

46. A speech encoding and decoding apparatus for dividing an input speech into spectrum envelope information and excitation signal information, encoding said excitation signal information by the frame, and decoding the encoded excitation signal information so as to generate an output speech, the encoding side of said speech encoding and decoding apparatus comprising:

target speech generation means for generating from said input speech a target speech vector of a vector length corresponding to a delay parameter;

a random codebook for generating a random vector of said vector length corresponding to said delay parameter;

random code search means for evaluating the distortion of a synthesis vector obtained from said random vector with respect to said target speech vector so as to search for a random vector conducive to the least distortion; and frame excitation generation means for generating an excitation signal of a frame length from said random vector conducive to the least distortion;

wherein said target speech generation means divides an input speech in a frame into portions each having said vector length corresponding to said delay parameter, and computes a weighted mean of the input speech portions each having said vector length so as to generate said target speech vector;

the decoding side of said speech encoding and decoding apparatus comprising:

a random codebook for generating said random vector of said vector length corresponding to said delay parameter; and frame excitation generation means for generating said excitation signal of said frame length from said random vector.

47. A speech encoding apparatus for dividing an input speech into spectrum envelope information and excitation signal information and for encoding said excitation signal information by frame, said speech encoding apparatus comprising:

an adaptive codebook for generating, from previously generated excitation signals of a frame length, an adaptive vector of a vector length corresponding to a delay parameter; and adaptive code search means for evaluating the distortion of a synthesis vector from said adaptive vector to determine an adaptive vector conducive to the least distortion, of a vector length corresponding to a delay parameter conducive to the least distortion, wherein said target speech generation means divides an input speech in a frame into portions each leaving said vector length corresponding to said delay parameter, and computes a weighted mean of the input speech portions each having said vector length so as to generate said target speech vector.

* * * * *